US007392772B2

(12) United States Patent
Janak et al.

(10) Patent No.: US 7,392,772 B2
(45) Date of Patent: Jul. 1, 2008

(54) PRIMARY AND OFFSET ACTUATOR ROCKER ARMS FOR ENGINE VALVE ACTUATION

(75) Inventors: Robb Janak, Colebrook, CT (US); Zdenek S. Meistrick, West Granby, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 11/123,063

(22) Filed: May 6, 2005

(65) Prior Publication Data

US 2006/0005796 A1 Jan. 12, 2006

Related U.S. Application Data

(60) Provisional application No. 60/568,231, filed on May 6, 2004.

(51) Int. Cl.
*F01L 9/02* (2006.01)

(52) U.S. Cl. ..... 123/90.12; 123/90.15; 123/90.16

(58) Field of Classification Search ..... 123/90.12, 123/90.15, 90.16
See application file for complete search history.

(56) References Cited

U.S. PATENT DOCUMENTS 4,726,332 A 2/1988 Nishimura et al.
4,768,475 A 9/1988 Ikemura
4,887,563 A 12/1989 Ishida et al.
5,033,420 A 7/1991 Matayoshi et al.
5,042,437 A 8/1991 Sakuragi et al.
5,099,806 A 3/1992 Murata et al.
5,186,128 A 2/1993 Murata et al.
5,203,289 A 4/1993 Hara et al.
5,207,193 A 5/1993 Sugimoto et al.
5,239,952 A 8/1993 Morita
5,388,552 A 2/1995 Sugimoto et al.
5,441,020 A 8/1995 Murata et al.
5,655,499 A 8/1997 Uehara et al.
5,758,620 A 6/1998 Warner
5,809,952 A 9/1998 Ono et al.

(Continued)

FOREIGN PATENT DOCUMENTS

DE 4025569 8/1990

(Continued)

*Primary Examiner*—Zelalem Eshete
(74) *Attorney, Agent, or Firm*—David R. Yohannan, Esq.; Kelley Drye & Warren LLP

(57) ABSTRACT

Systems and methods for actuating engine valves are disclosed. The systems may include primary and auxiliary rocker arms disposed adjacent to each other on a rocker arm shaft. The primary rocker arm may actuate an engine valve for primary valve actuation motions, such as main exhaust events, in response to an input from a first valve train element, such as a cam. The auxiliary rocker arm may receive one or more auxiliary valve actuation motions, such as for engine braking, exhaust gas recirculation, and/or brake gas recirculation events, from a second valve train element. A hydraulic actuator piston may be disposed between the auxiliary rocker arm and the primary rocker arm. The actuator piston may be selectively locked into an extended position between the primary and auxiliary rocker arms so as to selectively transfer the one or more auxiliary valve actuation motions from the auxiliary rocker arm to the primary rocker arm.

58 Claims, 16 Drawing Sheets

U.S. PATENT DOCUMENTS

| | | | | |
|---|---|---|---|---|
| 5,975,251 | A | 11/1999 | McCarthy | |
| 6,000,374 | A | 12/1999 | Cosma et al. | |
| 6,032,643 | A | 3/2000 | Hosaka et al. | |
| 6,257,201 | B1 | 7/2001 | Kajiura et al. | |
| 6,314,926 | B1 | 11/2001 | Meneely et al. | |
| 6,983,725 | B2 | 1/2006 | Persson | |
| 2004/0237932 | A1 * | 12/2004 | Persson | 123/321 |

FOREIGN PATENT DOCUMENTS

| | | | |
|---|---|---|---|
| DE | 4025569 | C1 * | 7/1991 |
| JP | 05-033684 | | 2/1993 |
| JP | 08-284630 | | 10/1996 |
| JP | 09-184407 | | 7/1997 |
| JP | 09-256828 | | 9/1997 |
| JP | 2000-186518 | A | 7/2000 |
| SE | 523849 | | 5/2004 |

* cited by examiner

PRIMARY AND OFFSET ACTUATOR ROCKER ARMS FOR ENGINE VALVE ACTUATION

CROSS-REFERENCE TO RELATED APPLICATIONS

The present application relates to, and claims the priority of, U.S. Provisional Patent Application Ser. No. 60/568,231, filed May 6, 2004, which is entitled "Offset Actuator Rocker Arm for Engine Valve Actuation."

FIELD OF THE INVENTION

The present invention relates to systems and methods for actuating valves in internal combustion engines.

BACKGROUND OF THE INVENTION

Internal combustion engines typically use either a mechanical, electrical, or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder. Near the end of the exhaust stroke, another lobe on the camshaft may open the intake valve for the main intake event at which time the piston travels away from the cylinder head. The intake valve closes and the intake stroke ends when the piston is near bottom dead center. Both the intake and exhaust valves are closed as the piston again travels upward for the compression stroke.

The above-referenced main intake and main exhaust valve events are required for positive power operation of an internal combustion engine. Additional auxiliary valve events, while not required, may be desirable. For example, it may be desirable to actuate the intake and/or exhaust valves during positive power or other engine operation modes for compression-release engine braking, bleeder engine braking, exhaust gas recirculation (EGR), brake gas recirculation (BGR), or other auxiliary intake and/or exhaust valve events. FIG. 19 illustrates examples of a main exhaust event 600, and auxiliary valve events, such as a compression-release engine braking event 610, bleeder engine braking event 620, exhaust gas recirculation event 640, and brake gas recirculation event 630, which may be carried out by an engine valve using various embodiments of the present invention to actuate engine valves for main and auxiliary valve events.

With respect to auxiliary valve events, flow control of exhaust gas through an internal combustion engine has been used in order to provide vehicle engine braking. Generally, engine braking systems may control the flow of exhaust gas to incorporate the principles of compression-release type braking, exhaust gas recirculation, exhaust pressure regulation, and/or bleeder type braking.

During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center (TDC) position, at least one exhaust valve may be opened to release the compressed gases in the cylinder to the exhaust manifold, preventing the energy stored in the compressed gases from being returned to the engine on the subsequent expansion down-stroke. In doing so, the engine may develop retarding power to help slow the vehicle down. An example of a prior art compression release engine brake is provided by the disclosure of the Cummins, U.S. Pat. No. 3,220,392 (November 1965), which is hereby incorporated by reference.

During bleeder type engine braking, in addition to, and/or in place of, the main exhaust valve event, which occurs during the exhaust stroke of the piston, the exhaust valve(s) may be held slightly open during the remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

Exhaust gas recirculation (EGR) systems may allow a portion of the exhaust gases to flow back into the engine cylinder during positive power operation. EGR may be used to reduce the amount of $NO_x$ created by the engine during positive power operations. An EGR system can also be used to control the pressure and temperature in the exhaust manifold and engine cylinder during engine braking cycles. Generally, there are two types of EGR systems, internal and external. External EGR systems recirculate exhaust gases back into the engine cylinder through an intake valve(s). Internal EGR systems recirculate exhaust gases back into the engine cylinder through an exhaust valve(s) and/or an intake valve(s). Embodiments of the present invention primarily concern internal EGR systems.

Brake gas recirculation (BGR) systems may allow a portion of the exhaust gases to flow back into the engine cylinder during engine braking operation. Recirculation of exhaust gases back into the engine cylinder during the intake stroke, for example, may increase the mass of gases in the cylinder that are available for compression-release braking. As a result, BGR may increase the braking effect realized from the braking event.

SUMMARY OF THE INVENTION

Responsive to the foregoing challenges, Applicant has developed an innovative system for actuating an engine valve comprising: a rocker arm shaft; a means for imparting primary valve actuation motion; a primary rocker arm disposed on the rocker arm shaft, the primary rocker arm being adapted to actuate an engine valve and receive motion from the means for imparting primary valve actuation motion; a means for imparting auxiliary valve actuation motion; an auxiliary rocker arm disposed on the rocker arm shaft adjacent to the primary rocker arm, the auxiliary rocker arm being adapted to receive motion from the means for imparting auxiliary valve actuation motion; and a hydraulic actuator piston disposed between the auxiliary rocker arm and the primary rocker arm, the actuator piston being adapted to selectively transfer one or more auxiliary valve actuation motions from the auxiliary rocker arm to the primary rocker arm.

Applicant has further developed an innovative system for actuating one or more engine valves comprising: a rocker arm shaft; a first valve train element; a first rocker arm disposed on the rocker arm shaft, the first rocker arm being adapted to contact the first valve train element and an engine valve or engine valve bridge; a boss provided on an end of the first rocker arm; a bore formed in the boss; an actuator piston disposed in the bore; a second valve train element; and a second rocker arm disposed on the rocker arm shaft between the second valve train element and the actuator piston, wherein the actuator piston is adapted to selectively transfer a valve actuation motion from the second valve train element to the first rocker arm.

Applicant has developed an innovative method of actuating an engine valve for primary and auxiliary valve actuation events using a primary rocker arm, an auxiliary rocker arm, and a hydraulic actuator piston disposed between the ends of the primary and auxiliary rocker arms that are proximal to the engine valve, the method comprising the steps of: actuating the engine valve for a primary valve actuation event responsive to motion imparted from a first valve train element to the primary rocker arm during a primary valve actuation mode of engine operation; extending and locking the hydraulic actuator piston into a position between the actuation ends of the primary and auxiliary rocker arms; actuating the engine valve for one or more auxiliary valve actuation events responsive to motion imparted from a second valve train element to the auxiliary rocker arm during an auxiliary valve actuation mode of engine operation.

Applicant has further developed an innovative system for actuating an engine valve comprising: a rocker arm shaft; a first rocker arm disposed on the rocker arm shaft and having an end proximal to the engine valve; a means for imparting a first valve actuation motion to the first rocker arm; a second rocker arm disposed on the rocker arm shaft adjacent to the first rocker arm, the second rocker arm having an end proximal to the engine valve; a means for imparting one or more second valve actuation motions to the second rocker arm, the second valve actuation motions being selected from the group consisting of: engine braking motion, exhaust gas recirculation motion, main exhaust motion, main intake motion, auxiliary intake motion, and brake gas recirculation motion; a hydraulic actuator piston disposed between the ends of the second rocker arm and the first rocker arm that are proximal to the engine valve, the actuator piston having an axis extending in a direction substantially co-planar with a rotation direction of the first and second rocker arms; and a hydraulic fluid control valve disposed in either the first rocker arm or the second rocker arm, the control valve adapted to selectively control the position of the hydraulic actuator piston.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS OF THE INVENTION

Figure 1:
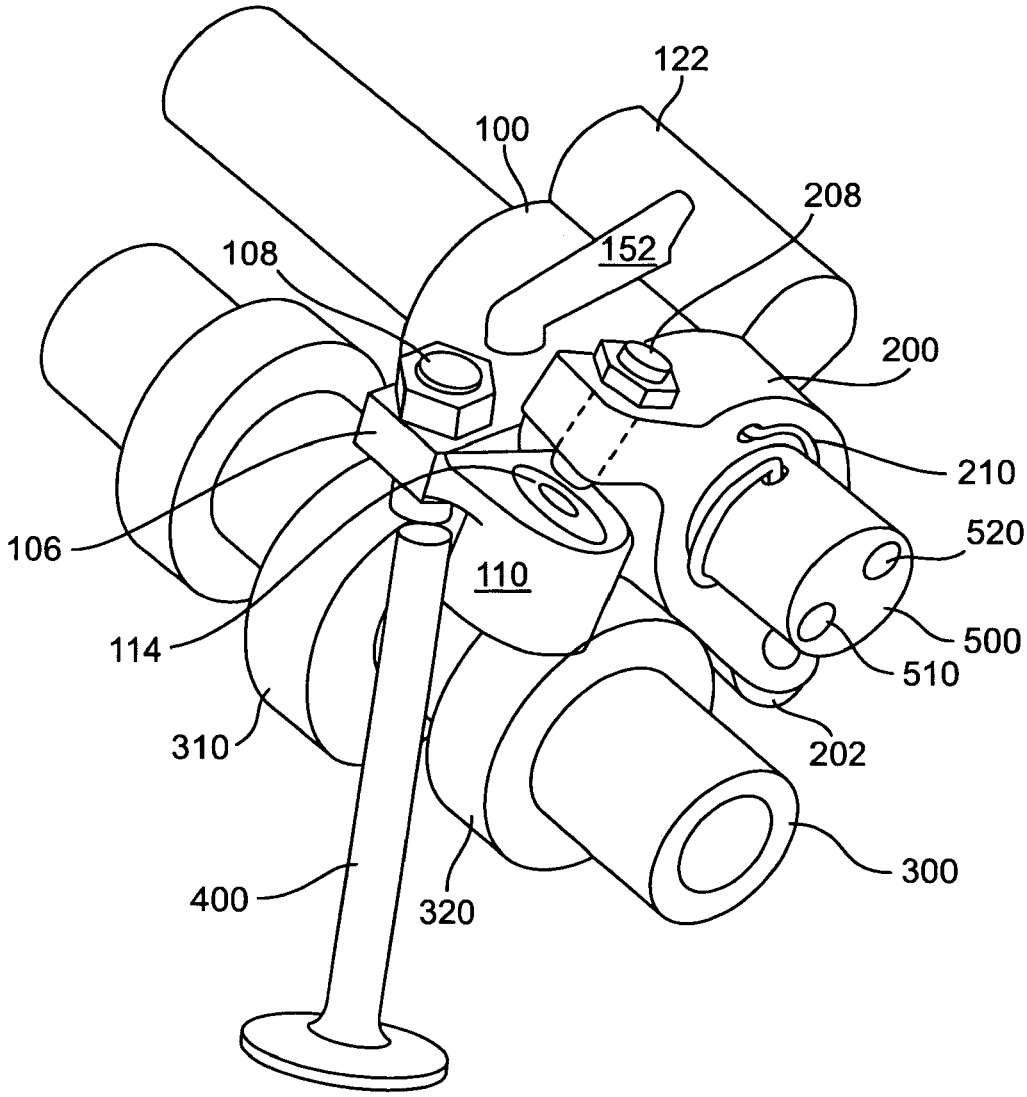
FIG. 1 is a pictorial view of the front side of a offset actuator rocker arm system assembled in accordance with a first embodiment of the present invention.
Figure 2:
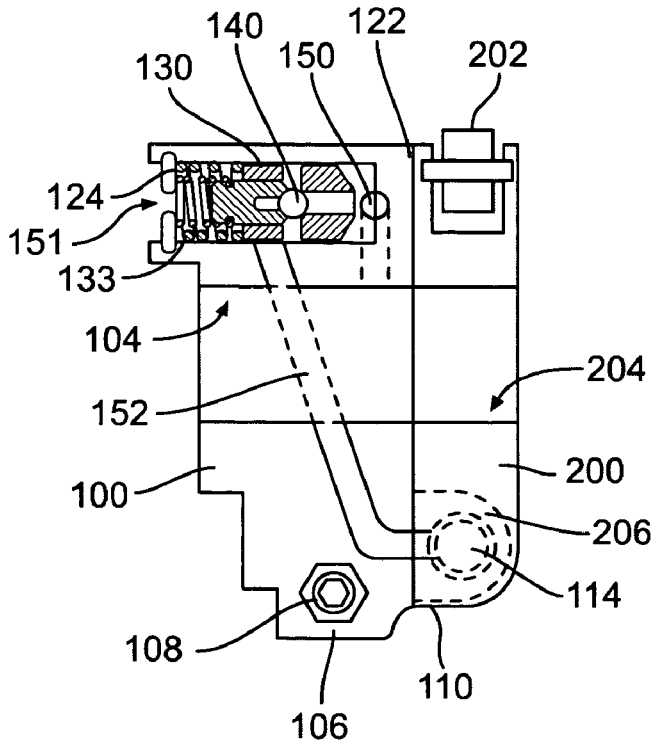
FIG. 2 is a top plan view in partial cross-section of the embodiment of the present invention shown in FIG. 1.
Figure 4:
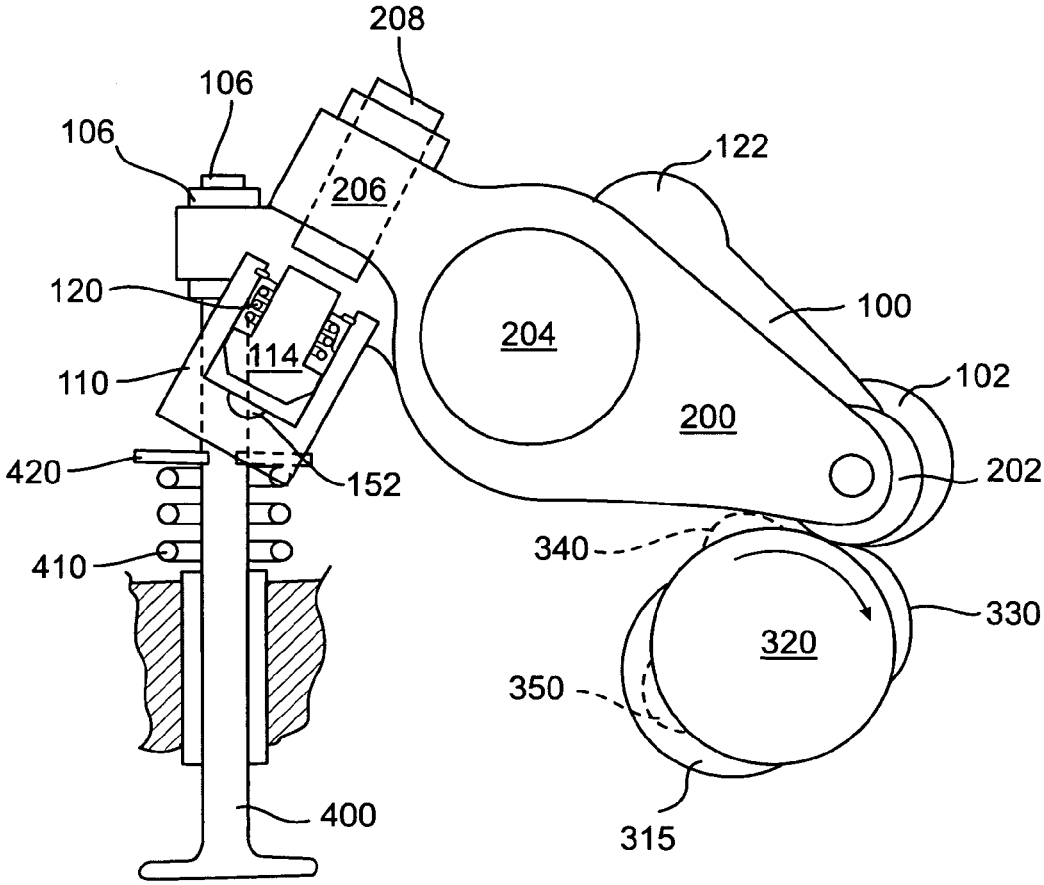
FIG. 4 is a side view in partial cross-section of the embodiment of the present invention shown in FIG. 1.

Reference will now be made in detail to a first embodiment of the present invention, an example of which is illustrated in the accompanying drawings. With reference to FIG. 1, a system for actuating engine valves is shown. FIG. 2 is a top view in cross-section of the exhaust (i.e., primary) rocker arm 100 and the adjacent offset (i.e., auxiliary) rocker arm 200, which are shown in FIG. 1. FIG. 4 is a side view in partial cross-section of the exhaust rocker arm 100 and the offset rocker arm 200, which are shown in FIGS. 1 and 2. The engine valves referenced constitute poppet-type valves that are used to control communication between the combustion chambers (e.g., cylinders) in an engine and aspirating (e.g., intake and exhaust) manifolds. The system includes a rocker arm shaft 500 on which at least two rocker arms are disposed. The rocker arms may be pivoted about the rocker arm shaft 500 as a result of motion imparted to them by a camshaft 300 or some other motion imparting device.

The rocker arms may include an exhaust rocker arm 100 and an offset rocker arm 200. The exhaust rocker arm 100 is adapted to actuate an engine valve, such as an exhaust valve 400, by contacting it directly (shown) or through a valve bridge (not shown). The offset rocker arm 200 is adapted to selectively actuate at least one exhaust valve 400 by contacting the exhaust rocker arm 100, and acting through the exhaust rocker arm on the exhaust valve.

The rocker arm shaft 500 may include one or more internal passages for the delivery of hydraulic fluid, such as engine oil, to the rocker arms mounted thereon. Specifically, the rocker arm shaft 500 may include a constant fluid supply passage 510 and a control fluid supply passage 520. The constant fluid supply passage 510 may provide lubricating or actuation fluid to one or more of the rocker arms during engine operation. The control fluid supply passage 520 may provide hydraulic fluid to one or more of the rocker arms to facilitate use of the offset rocker arm 200 for controlling valve actuation.

The exhaust rocker arm 100 may include one or more internal passages for the delivery of hydraulic fluid through the exhaust rocker arm. With reference to both FIGS. 1 and 2, the exhaust rocker arm 100 includes a rocker shaft bore 104 extending laterally through a central portion of the rocker arm. The rocker shaft bore 104 may be adapted to receive the rocker arm shaft 500. The rocker shaft bore 104 may include one or more ports formed in the wall thereof to receive fluid from the fluid passages formed in the rocker arm shaft 500.

The exhaust rocker arm 100 may include a valve actuation end 106 and a lash adjustment screw 108. The lash adjustment screw 108 may protrude from the bottom of the valve actuation end 106 and permit adjustment of the lash space between the valve actuation end 106 of the exhaust rocker arm and the exhaust valve 400. The lash adjustment screw may be locked in place by a nut. Optionally, a self-adjusting hydraulic lash adjuster may be substituted for the manually-adjustable lash adjustment screw, or lash adjustment may not be provided at all.

Figure 3:
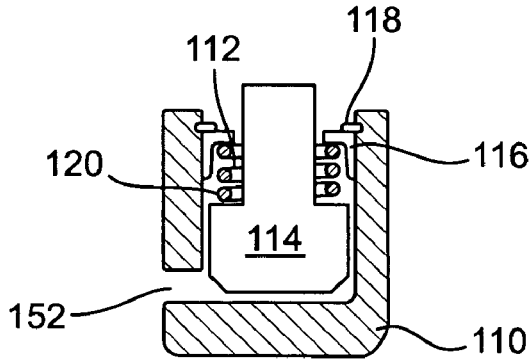
FIG. 3 is a side view in cross-section of an actuator piston assembly used in the embodiment of the present invention shown in FIG. 1.

With reference to FIGS. 1 and 4, an actuator piston boss 110 may extend laterally from the valve actuation end 106 of the exhaust rocker arm so that it is positioned below the valve actuation end 206 of the offset rocker arm 200. FIG. 3 is a side view in cross-section of an actuator piston boss 110. An actuator piston bore 112 may be formed in the boss 110. An actuator piston 114 may be slidably disposed in the piston bore 112. A piston retaining cup 116 may be located near the open end of the piston bore 112. The retaining cup 116 may have a central opening through which the actuator piston 114 may extend. The retaining cup 116 may be prevented from sliding out of the piston bore 112 by a retaining washer 118. An optional spring 120 may extend between the retaining cup 116 and a shoulder provided on the actuator piston 114 so that the actuator piston is biased into the piston bore 112. A supply fluid passage 152 may be connected to the piston bore 112 near the bottom of the actuator piston 114.

With renewed reference to FIG. 2, the exhaust rocker arm 100 may also include a control valve boss 122 at the end of the rocker arm distal from the valve actuation end 106. A control valve piston 130 may be disposed in a control valve bore 124 formed in the control valve boss 122. The control valve piston 130 may control the supply of hydraulic fluid to the actuator piston 114.

Figure 5:
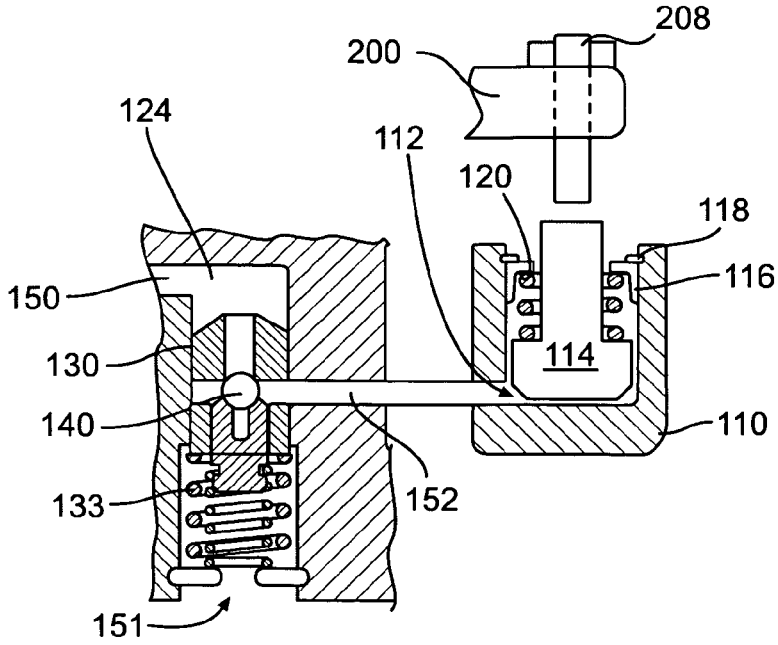
FIG. 5 is a side view in cross-section of the actuator piston assembly and control valve assembly used in the embodiment of the present invention shown in FIG. 1.

FIG. 5 shows the detail of the control valve piston 130 used in the first embodiment of the present invention. The control valve piston 130 may be a cylindrically shaped element with one or more internal passages, and which may incorporate an internal control check valve 140. The check valve 140 may permit fluid to pass from the control fluid passage 150 to the supply fluid passage 152, but not in the reverse direction. The control valve piston 130 may be spring biased by one or more control valve springs 133 into the control valve bore 124 toward a port that connects the control valve bore to the control fluid passage 150. A central internal passage may extend axially from the inner end of the control valve piston 130 towards the middle of the control valve piston where the control check valve 140 may be located. The central internal passage in the control valve piston 130 may communicate with one or more passages extending across the diameter of the control valve piston 130. As a result of translation of the control valve piston 130 relative to its bore 124, the passages extending through the control valve piston 130 may selectively register with a port that connects the side wall of the control valve bore with the supply fluid passage 152. When the passages extending through the control valve piston 130 register with the supply fluid passage 152, low pressure fluid may flow from the control fluid passage 150, through the control valve piston 130, and into the supply fluid passage 152.

With renewed reference to FIG. 4, an exhaust rocker cam roller 102 may be connected to the exhaust rocker arm 100 underneath the control valve boss 122. The exhaust rocker cam roller 102 may contact an exhaust cam 310 (shown in FIG. 1) provided on the cam shaft 300. The exhaust cam 310 may include one or more lobes, including a lobe adapted to produce a primary valve opening event, such as a main exhaust event, by imparting a primary valve actuation motion to the exhaust rocker arm 100. It is appreciated that the primary valve actuation motion may be imparted to the exhaust rocker arm 100 by any number of alternative valve train elements, including but not limited to cams, push tubes, rocker arms, levers, hydraulic and electromechanical actuators, and the like.

The exhaust rocker arm 100 may have one or more internal fluid passages, including a control fluid passage 150 and a supply fluid passage 152. The control fluid passage 150 may extend through the exhaust rocker arm 100 from the control valve bore 124 to a port (not shown) communicating with the rocker shaft bore 104. In turn, the port communicating with the rocker shaft bore 104 may register with the control fluid supply passage 520 provided in the rocker arm shaft 500 when the exhaust rocker arm is mounted on the rocker arm shaft. With reference to FIGS. 2 and 3, the supply fluid passage 152 may extend through the exhaust rocker arm 100 from the control valve bore 124 to the actuator piston bore 112.

With renewed reference to FIGS. 1, 2 and 4, the offset rocker arm 200 includes a rocker shaft bore 204 extending laterally through a central portion of the offset rocker arm. The rocker shaft bore 204 may be adapted to receive the rocker arm shaft 500. The rocker shaft bore 204 may include one or more ports formed in the wall thereof to receive fluid from the fluid passages formed in the rocker arm shaft 500. The offset rocker arm 200 may further include a valve actuation end 206 and a lash adjustment screw 208. The lash adjustment screw 208 may protrude from the bottom of the valve actuation end 206 and permit adjustment of the lash space between the valve actuation end 206 of the offset rocker arm and the actuator piston 114. The lash adjustment screw 208 may be locked in place by a nut. Optionally, a hydraulic or other self-adjusting lash adjuster may be substituted for the lash adjustment screw 208.

An offset rocker cam roller 202 may be connected to the offset rocker arm 200. The offset rocker cam roller 202 may contact an auxiliary cam 320 provided on the cam shaft 300. With reference to FIG. 4 in particular, the auxiliary cam 320 may include one or more cam lobes such as for example, an engine braking cam lobe 330, an exhaust gas recirculation (EGR) cam lobe 340, and/or a brake gas recirculation (BGR) cam lobe 350 adapted to impart one or more auxiliary valve actuation motions to the offset actuator rocker arm 200. It is appreciated that these auxiliary valve actuation motions may be imparted to the offset actuator rocker arm 200 by any number of alternative valve train elements, including but not limited to cams, push tubes, rocker arms, levers, hydraulic and electromechanical actuators, and the like. The engine braking cam lobe 330 may be adapted to provide compression-release, bleeder, or partial bleeder engine braking. Compression-release engine braking involves opening an exhaust valve (or an auxiliary engine valve) near the top dead center position for the engine piston on compression strokes (and/or exhaust strokes for two-cycle braking) for the piston. Bleeder engine braking involves opening an exhaust valve for the complete engine cycle; and partial bleeder engine braking involves opening an exhaust valve for a significant portion of the engine cycle. The optional EGR lobe may be used to provide an EGR event during a positive power mode of engine operation. The optional BGR lobe may be used to provide a BGR event during an engine braking mode of engine operation. The valve actuation motions provided by the engine braking lobe 330, the EGR lobe 340, and the BGR lobe 350 are intended to be examples of auxiliary valve actuation motions that may be provided by the offset actuator rocker arm 200.

With reference to FIG. 1, a mousetrap type spring 210 may engage the offset rocker arm 200 and the rocker shaft 500. As shown, the spring 210 may bias the offset rocker arm 200 toward the cam shaft 300. The spring 210 may have sufficient strength to maintain the offset rocker arm 200 in contact with the auxiliary cam 320 throughout the rotation of the cam shaft. In an alternative embodiment, the spring 210 may bias the offset rocker arm 200 toward the actuator piston 114. In such embodiments, extension of the actuator piston 114 from the piston bore 112 may cause the offset rocker arm 200 to rotate backward against the bias of the spring 210 so that it may contact the auxiliary cam 320 only when the actuator piston is hydraulically extended.

In other embodiments, the rocker arms may include an intake rocker arm 100. The intake rocker arm 100 may be adapted to actuate an engine valve, such as an intake valve 400, by contacting it directly or through a valve bridge. The offset rocker arm 200 may be adapted to selectively actuate at least one intake valve 400 by contacting the intake rocker arm 100, and acting through the intake rocker arm on the intake valve. It is contemplated that an intake cam may impart primary valve actuation motion to the intake rocker arm to provide a main intake event, and an auxiliary cam may impart auxiliary valve actuation motion to the offset rocker arm 200 to provide auxiliary intake events, such as, for example, exhaust gas recirculation, and/or brake gas recirculation.

Operation in accordance with a first method embodiment of the present invention, using the system for actuating engine valves shown in FIGS. 1-5, will now be explained. With reference to FIGS. 1-5, engine operation causes the cam shaft 300 to rotate. The rotation of the exhaust cam 310 causes the exhaust rocker arm 100 to pivot about the rocker shaft 500 and actuate the exhaust valve 400 for main exhaust events in response to interaction between the main exhaust lobe 315 on the exhaust cam and the exhaust cam roller 102. Likewise, each lobe on the auxiliary cam 320 may cause the offset rocker arm 200 to pivot about the rocker shaft 500 toward the actuator piston 114.

During positive power operation of the system, fluid pressure in the control fluid supply passage 520 may be vented or reduced, which in turn may cause fluid pressure in the control fluid passage 150 (see FIG. 2) to vent or recede. With reference to FIG. 5, as a result, the internal fluid passages in the control valve piston 130 may cease to register with the port connecting the control valve bore 124 to the supply fluid passage 152 as the control valve 130 translates into the control valve bore under the influence of the control valve spring 133. Fluid in the supply fluid passage 152 may then vent past the rear of the control valve piston 130 and out of the control valve bore 124 through the opening 151. As a result, the actuator piston 114 may collapse into the actuator piston bore 112 under the influence of the piston spring 120, and/or in embodiments that do not include an optional piston spring, as a result of the movement of the adjacent exhaust rocker arm 100.

With reference to FIG. 1, the offset rocker arm 200 may be biased toward the auxiliary cam 320 by the spring 210. As a result of the actuator piston 114 being biased into the bore 112 and the offset rocker arm 200 being biased toward the auxiliary cam 320, a lash space may exist between the valve actuation end 206 of the offset rocker arm 200 and the actuator piston when the auxiliary cam 320 is at base circle and fluid pressure in the fluid supply passage 520 is vented or reduced. Preferably, this lash space prevents the offset rocker arm 200 from pivoting the exhaust rocker arm 100 when the offset rocker arm is pivoted by the lobe or lobes on the auxiliary cam 320. Thus, during positive power, movement of the offset rocker arm 200 in response to the auxiliary cam 320 may not produce any actuation of the exhaust valve 400.

When auxiliary exhaust valve actuation is desired for engine braking, EGR, and/or BGR, the fluid pressure in the control fluid supply passage 520 may be increased. A solenoid actuated valve (not shown) may be used to control the application of increased fluid pressure in the control fluid supply passage 520. Increased fluid pressure in the control fluid supply passage 520 is applied through the control fluid passage 150 in the exhaust rocker arm 100 to the control valve piston 130. When the auxiliary valve actuation is engine braking, for example, the control valve piston 130 may be displaced in the control valve bore 124 into an "engine brake on" position, wherein the internal fluid passages in the control valve piston 130 register with the supply fluid passage 152, as shown in FIG. 5. The check valve 140 may prevent fluid that enters the supply fluid passage 152 from flowing back through the control valve piston 130. Fluid pressure in the supply fluid passage 152 may be sufficient to overcome the bias force of the optional piston spring 120. As a result, the actuator piston 114 may extend out of the bore 112 and take up the lash space between the actuator piston and the offset rocker arm 206 when the auxiliary cam 320 is at base circle. As long as low pressure fluid maintains the control valve piston 130 in the "engine brake on" position, the actuator piston 114 may be hydraulically locked into an extended position. Thereafter, pivoting of the offset rocker arm 200 by the auxiliary cam 320 may produce a valve actuation corresponding to each lobe on the auxiliary cam (i.e., lobes 330, 340, and/or 350) because there is reduced or no lash space between the offset rocker arm and the actuator piston. When auxiliary exhaust valve actuation is no longer desired, pressure in the control fluid supply passage 520 may be reduced or vented and the control valve piston 130 will return to an "engine brake off" position. Fluid in the actuator piston bore 112 may then vent back through the supply fluid passage 152 and out of the control valve bore 124 through opening 151.

In an alternative embodiment, the actuator piston 114 may be biased out of the bore 112 by an optional spring (not shown), low hydraulic pressure applied through the supply fluid passage 152, or some combination of the two, during positive power operation. Although the actuator piston 114 may be biased out of the bore 112 in this alternative embodiment, it is not hydraulically locked into this position during positive power. As a result of the actuator piston 114 being biased out of the bore 112, any lash space between the valve actuation end 206 of the offset rocker arm 200 and the actuator piston may be taken up when the auxiliary cam 320 is at base circle. When the offset rocker arm is pivoted by the lobe or lobes on the auxiliary cam 320, the actuator piston 114 may be pushed into the bore 112 the distance of the lash space before the movement of the offset rocker arm 200 produces movement of the exhaust rocker arm 100. As with the first embodiment, this lash space is preferably sufficient to prevent the offset rocker arm 200 from pivoting the exhaust rocker arm 100 when the offset rocker arm is pivoted by the auxiliary cam 320.

FIGS. 6-11 show six different embodiments of the actuator piston and control valve assemblies which may be substituted for the corresponding assemblies shown in FIG. 5. The fluid passage(s) connecting the actuator piston and control valve assemblies are shortened in FIGS. 6-11 for ease of illustration. The alternative embodiments of the actuator piston and control valve assemblies may be separated into two groups. The first group includes the assemblies shown in FIGS. 6 and 7, which, like the assemblies shown in FIG. 5, use fluid from the control fluid passage 150 to turn the control valve piston 130 on and off, as well as to fill the actuator piston bore 112. The second group includes the assemblies shown in FIGS. 8-11, which use separate fluid passages to turn the control valve piston 130 on and off, and fill the actuator piston bore 112.

Figure 6:
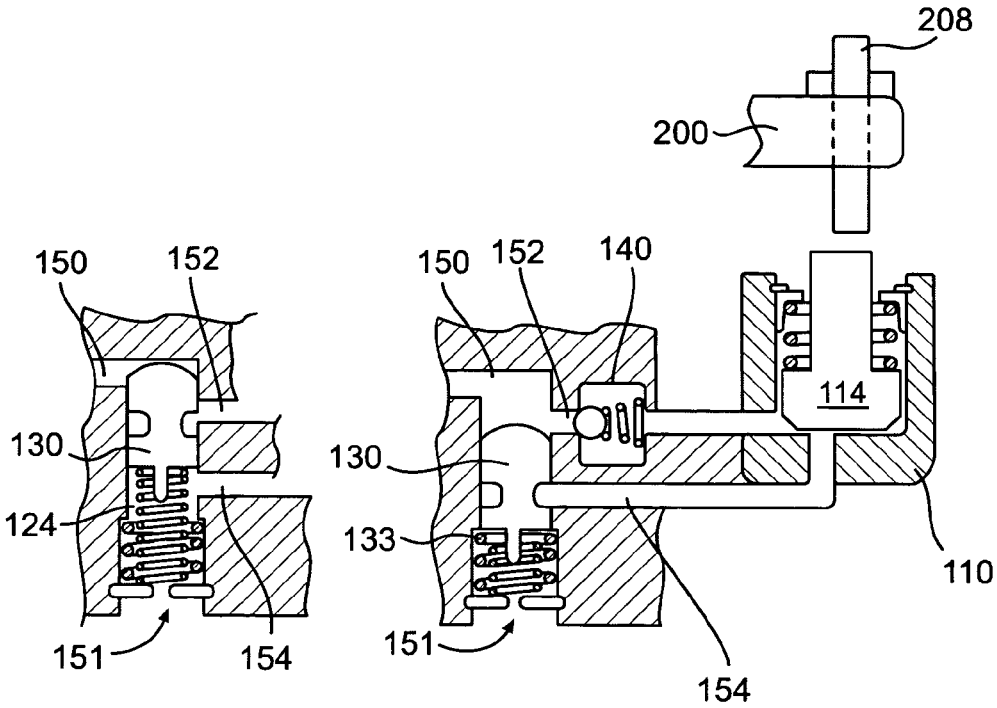
FIG. 6 is a side view in cross-section of a first alternative actuator piston and control valve assembly which may be substituted for the corresponding assemblies shown in the various embodiments of the present invention.

With reference to FIG. 6, the control valve piston 130 may be a solid cylindrical element with a circumferential recess provided in its sidewall. The control valve piston 130 may be spring biased by one or more control valve springs 133 into the control valve bore 124 toward a port that connects the control valve bore to the control fluid passage 150 when the control fluid passage is vented. The control valve piston 130 is in an "engine brake off" position when the control fluid passage 150 is vented (shown on the left in FIG. 6). In the "engine brake off" position, fluid in the actuator piston bore may vent out of the system through the drain passage 154 and the drain port 151. As a result, the actuator piston 114 may remain fully collapsed in its bore. Fluid pressure in the control fluid passage 150 may be increased to turn the engine brake on. Fluid pressure in control passage 150 may cause the control valve piston 130 to slide in its bore and permit communication between the control fluid passage 150 and the supply fluid passage 152, while at the same time cutting off communication between the drain port 151 and the drain passage 154 (shown on the right in FIG. 6). As a result, fluid may flow from the control fluid passage 150, through the supply fluid passage 152 and the check valve 140, and cause the actuator piston 114 to extend from its bore. The actuator piston 114 may become hydraulically locked in an extended position because the check valve 140 and the control valve piston 130 prevent back flow of fluid through either the supply passage 152 or the drain passage 154.

Figure 7:
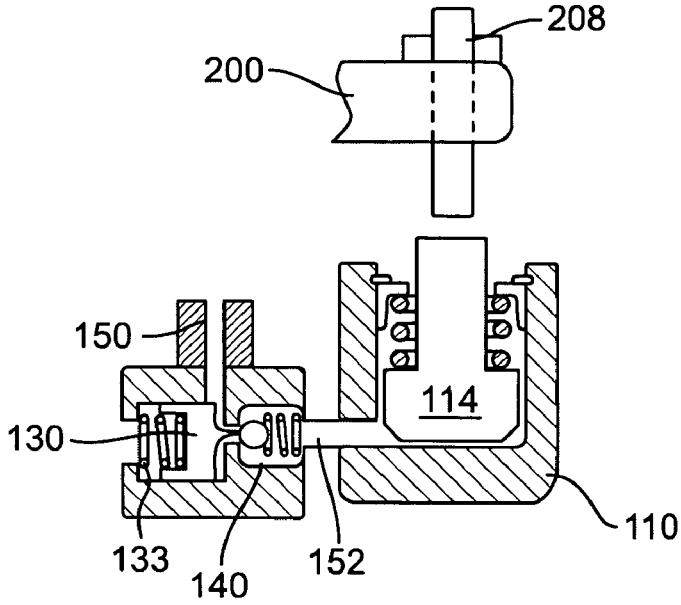
FIG. 7 is a side view in cross-section of a second alternative control valve assembly which may be substituted for the corresponding assembly shown in the various embodiments of the present invention.

With reference to FIG. 7, in an alternative embodiment, the control valve piston 130 may be a cup shaped member with a central protrusion at one end. The control valve piston may be spring biased into the control valve bore 124 toward a check valve 140 by one or more control valve springs 133. The cup shaped member may include a protrusion extending from one end toward the check valve 140. When the control valve piston 130 is positioned in an "engine brake off" position (i.e., there is little or no pressure in the control fluid passage 150), the control valve spring(s) 133 presses the control valve piston 130 into the check valve 140 so that the protrusion extending from the control valve piston may hold the check valve open. When held open by the control valve protrusion, fluid may flow in either direction past the check valve 140, and fluid in the actuator piston bore may vent back through the supply fluid passage 152, allowing the actuator piston 114 to remain collapsed in its bore. Fluid pressure in the control fluid passage 150 may be increased to turn the engine brake on. Increased fluid pressure in the control passage 150 may cause the control valve piston 130 to slide back in its bore away from the check valve 140. As the control valve piston 130 slides back, the protrusion disengages the check valve 140 so that it only permits one-way fluid flow into the actuator piston bore 112. As a result, the actuator piston 114 may become hydraulically locked in an extended position until the fluid pressure in the control passage 150 is reduced and the control valve piston 130 opens the check valve 140 again.

Figure 8:
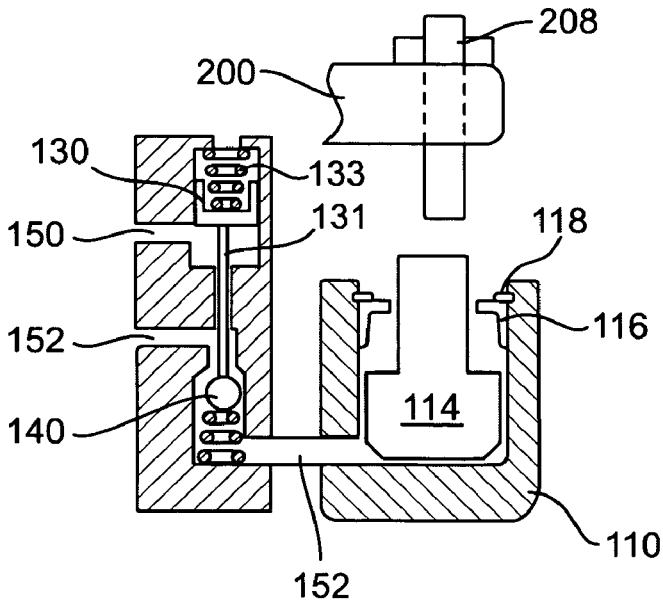
FIG. 8 is a side view in cross-section of a third alternative actuator piston assembly and control valve assembly which may be substituted for the corresponding assemblies shown in the various embodiments of the present invention.

With reference to FIG. 8, in another alternative embodiment, the control valve piston 130 may be a cup shaped member spring biased by control valve spring 133 toward a check valve 140. A pin 131 extends from the cup shaped member to the check valve 140. When the control valve piston 130 is positioned in an "engine brake off" position (i.e., there is little or no pressure in the control fluid passage 150), the control valve spring 133 may press the control valve piston 130 into the check valve 140 so that the pin 131 may hold the check valve open. When held open by the pin 131, fluid may flow in either direction past the check valve 140, and fluid in the actuator piston bore may vent back through the supply fluid passage 152, allowing the actuator piston 114 to move in its bore with the oil pressure in supply fluid passage 152. Fluid pressure in the control fluid passage 150 may be increased to turn the engine brake on. Increased fluid pressure in the control passage 150 may cause the control valve piston 130 to slide back in its bore away from the check valve 140. As the control valve piston 130 slides back, the pin 131 is no longer able to keep the check valve 140 open, and as a result the check valve only permits one-way fluid flow into the actuator piston bore 112 from the supply fluid passage 152. The supply fluid passage 152 may be provided with a constant supply of low pressure fluid that is independent from or common with the fluid in the control fluid passage. As a result, the actuator piston 114 may become hydraulically locked in an extended position until the fluid pressure in the control passage 150 is reduced and the control valve piston 130 opens the check valve 140 again.

Figure 9:
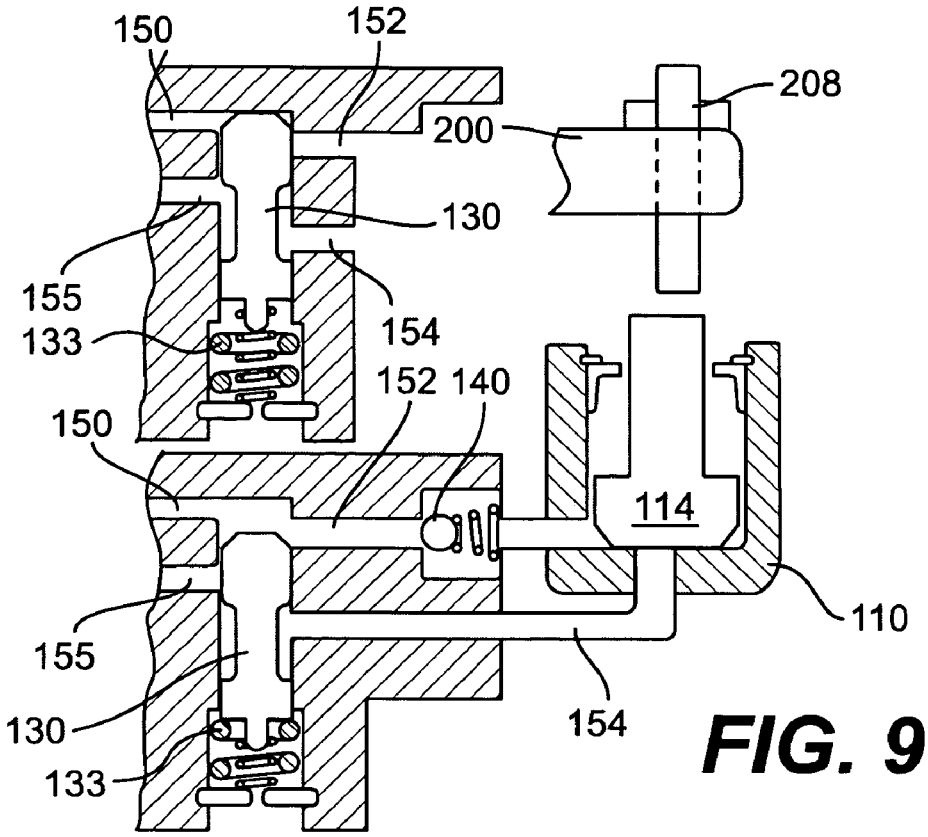
FIG. 9 is a side view in cross-section of a fourth alternative actuator piston assembly and control valve assembly which may be substituted for the corresponding assemblies shown in the various embodiments of the present invention.

With reference to FIG. 9, in yet another alternative embodiment of the control valve and actuator piston assemblies, the actuator piston 114 may not be spring biased into its bore. The control valve piston 130 may be a solid cylindrical element with a circumferential recess provided in its sidewall. The control valve piston 130 may be spring biased into the control valve bore 124 toward a port that connects the control valve bore to the control fluid passage 150 when the control fluid passage contains low pressure fluid. The control valve piston 130 is in an "engine brake off" position when the control fluid passage 150 contains low pressure fluid (shown on the top in FIG. 9). In the "engine brake off" position, a constant supply passage 155 may provide low pressure fluid from the constant fluid supply passage 510 to the actuator piston 114 through the drain passage 154 and extend the actuator piston into contact with the offset rocker arm 200. The low pressure fluid may cyclically vent back toward the constant fluid supply passage 510 and refill the actuator piston bore 112 as the offset rocker arm 200 causes the actuator piston to stroke up and down in its bore. As a result, the actuator piston 114 may absorb the motion imparted to it by the offset rocker arm, while at the same time remaining biased into contact with the offset rocker arm under the influence of fluid provided by the constant supply passage 155. Fluid pressure in the control fluid passage 150 may be increased to turn the engine brake on. Increased fluid pressure in control passage 150 may cause the control valve piston 130 to slide in its bore and permit communication between the control fluid passage 150 and the supply fluid passage 152, while at the same time cutting off communication between the drain passage 154 and the constant supply passage 155 (shown on the bottom in FIG. 9). As a result, fluid may flow from the control fluid passage 150, through the supply fluid passage 152 and the check valve 140, and cause the actuator piston 114 to remain extended from its bore. The actuator piston 114 may become hydraulically locked in an extended position because the check valve 140 and the control valve piston 130 prevent back flow of fluid through either the supply passage 152 or the drain passage 154. The actuator piston 114 may remain in an extended position until the fluid pressure in the control passage 150 is reduced and the control valve piston 130 reestablishes communication between the drain passage 154 and the constant supply 155.

Figure 10:
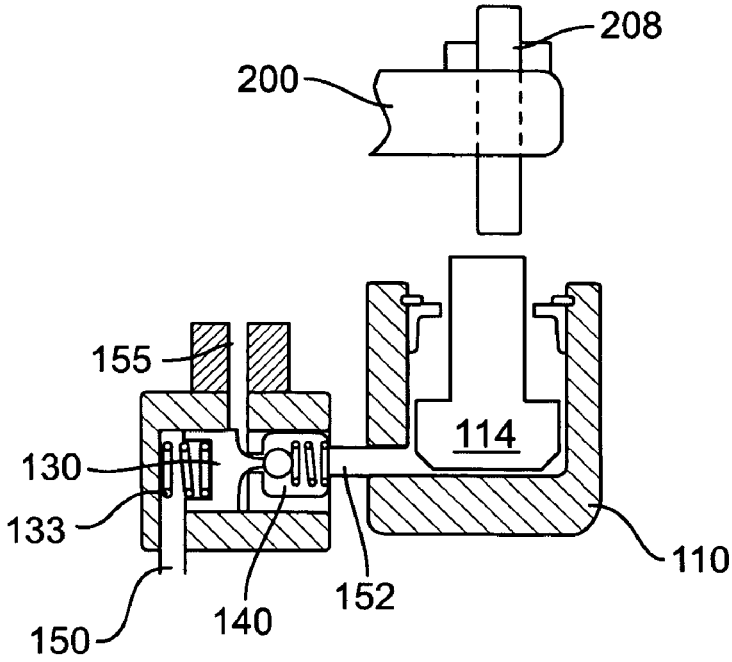
FIG. 10 is a side view in cross-section of a fifth alternative actuator piston assembly and control valve assembly which may be substituted for the corresponding assemblies shown in the various embodiments of the present invention.

With reference to FIG. 10, in another alternative embodiment of the control valve and actuator piston assemblies, the actuator piston 114 may not be spring biased into its bore. The control valve piston 130 may be a cup shaped member spring biased by a control valve spring 133 into the control valve bore 124 toward a check valve 140. The cup shaped member may include a protrusion extending from one end toward the check valve 140. A constant supply passage 155 may provide a constant supply of low pressure hydraulic fluid from passage 510 to the control valve piston 130. When the control valve piston 130 is positioned in an "engine brake off" position (i.e., there is an elevated level of pressure in the control fluid passage 150), the pressure applied to the control valve piston 130 by the control fluid passage 150 and the control valve spring 133 exceeds the counter-force exerted on the control valve piston by the constant supply passage 155 and the check valve 140. As a result, the control valve piston 130 is pressed into contact with the check valve 140 so that the protrusion extending from the control valve piston may hold the check valve open. Thus, in the "engine brake off" position, the constant supply passage 155 provides low pressure fluid to the actuator piston 114 through the supply passage 152 and extends the actuator piston into contact with the offset rocker arm 200. The low pressure fluid may cyclically vent back to the constant supply passage 155 and refill the actuator piston bore as the offset rocker arm 200 causes the actuator piston to stroke up and down in its bore. As a result, the actuator piston 114 may absorb the motion imparted to it by the offset rocker arm 200, while at the same time remaining biased into contact with the offset rocker arm under the influence of fluid provided by the constant supply passage 155. Fluid pressure in the control fluid passage 150 may be decreased or vented to turn the engine brake on. Decreased fluid pressure in the control passage 150 may cause the control valve piston 130 to slide back in its bore away from the check valve 140 because the pressure applied to one side of the control valve piston 130 by the constant supply passage 155 may exceed the pressure applied to the other side of the control valve piston by the control valve spring 133. As the control valve piston 130 slides back, the protrusion may disengage the check valve 140 so that it only permits one-way fluid flow into the actuator piston bore 112. Low pressure fluid from the constant supply passage 155 may still fill the actuator piston bore through the check valve 140. As a result, the actuator piston 114 may become hydraulically locked in an extended position until the fluid pressure in the control passage 150 is increased, and the control valve piston 130 opens the check valve 140 again for release of the fluid trapped in the actuator piston bore 112.

Figure 11:
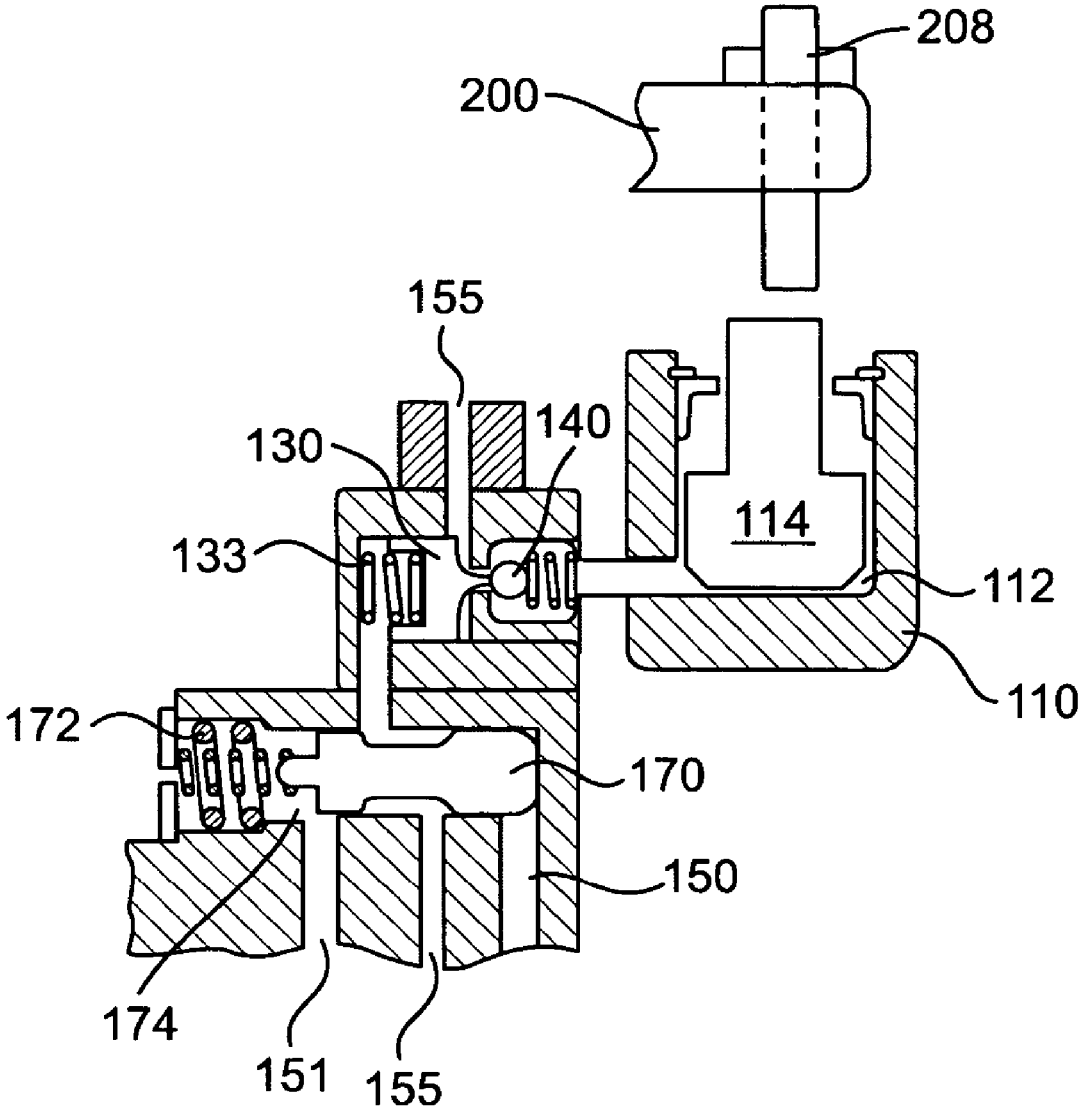
FIG. 11 is a side view in cross-section of a sixth alternative actuator piston assembly and control valve assembly which may be substituted for the corresponding assemblies shown in the various embodiments of the present invention.

With reference to FIG. 11, in another alternative embodiment of the control valve and actuator piston assemblies, the actuator piston 114 may not be spring biased into its bore. A first control valve piston 130 may be a cup shaped member spring biased by a control valve spring 133 into the control valve bore 124 toward a check valve 140. The cup shaped member may include a protrusion extending from one end toward the check valve 140. A constant supply passage 155 may provide a constant supply of low pressure hydraulic fluid to the control valve piston 130 from a constant supply passage 510 in the rocker arm shaft 500. A second control valve piston 170 may be an elongated cylinder with circumferential recess provided near the middle of the piston. The second control valve piston 170 may be biased by one or more springs 172 toward a control fluid passage 150. The second control valve bore 174 may also communicate with the constant supply passage 155 and a drain passage 151.

With continued reference to FIG. 11, when no auxiliary valve actuation is desired (e.g., during an "engine brake off" condition) control fluid pressure in the control fluid passage 150 is maintained low enough or vented such that the second control valve springs 172 maintain the second control valve piston 170 in a position like that shown in FIG. 11. When the second control valve piston 170 is positioned as shown in FIG. 11, both sides of the first control valve piston 130 are provided with fluid from the constant supply passage 155, which is of relatively equal pressure. As a result of the equal fluid pressure on both sides of the first control valve piston 130, the pressure applied to the first control valve piston by the control valve spring 133 exceeds the counter-force exerted on the first control valve piston by the check valve 140. As a result, the first control valve piston 130 protrusion is pressed into contact with the check valve 140 so that the check valve is held open. Low pressure fluid may be supplied by the constant supply passage 155 to the actuator piston bore 112 while the check valve 140 is held open, which in turn may extend the actuator piston 114 into contact with the offset rocker arm 200. The low pressure fluid in the actuator piston bore 112 may cyclically vent back to the constant supply passage 155 and refill the actuator piston bore as the offset rocker arm 200 causes the actuator piston to stroke up and down in its bore. As a result, the actuator piston 114 may absorb the motion imparted to it by the offset rocker arm 200, while at the same time remaining biased into contact with the offset rocker arm under the influence of fluid provided by the constant supply passage 155. Fluid pressure in the control fluid passage 150 may be increased to turn the engine brake on. Increased fluid pressure in the control fluid passage 150 may cause the second control valve piston 170 to slide away from the control fluid passage 150 so that communication between the constant fluid supply passage 155 and the back side of the first control valve piston 130 is cut off, and communication between the back side of the first control valve piston 130 and the drain passage 151 is established. The constant supply fluid pressure previously applied to the back side of the first control valve piston 130 is vented through the drain passage 151, and accordingly, the pressure applied to the front side of the first control valve piston may exceed the pressure applied to the back side. As a result, the first control valve piston 130 may slide back and the protrusion may disengage the check valve 140 so that it only permits one-way fluid flow into the actuator piston bore 112. Low pressure fluid from the constant supply passage 155 may still fill the actuator piston bore through the check valve 140. The actuator piston 114 may become hydraulically locked in an extended position until the fluid pressure in the control passage 150 is decreased and the first control valve piston 130 opens the check valve 140 again for release of the fluid trapped in the actuator piston bore 112.

Figure 12:
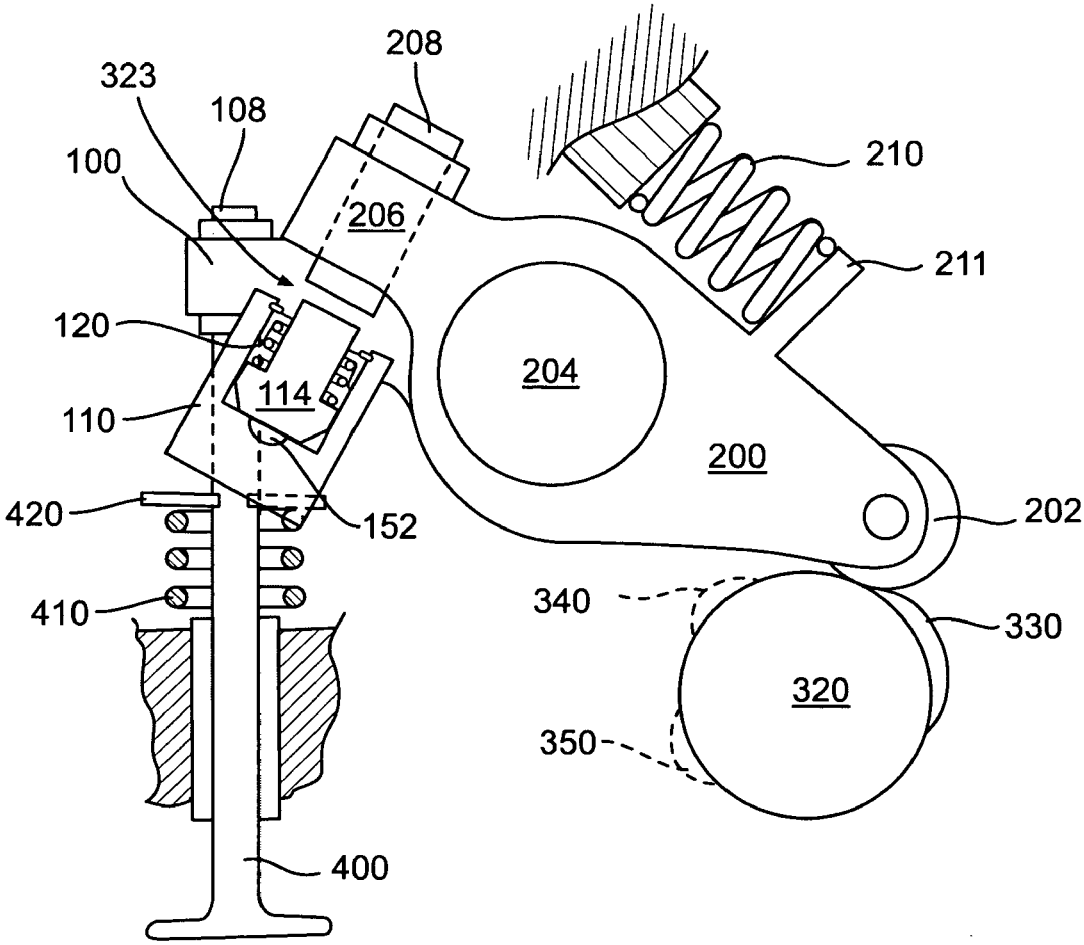
FIG. 12 is a side view in partial cross-section of an offset actuator rocker arm system assembled in accordance with a second embodiment of the present invention.

With reference to FIG. 12, a side view in partial cross-section is shown of an offset actuator rocker arm system assembled in accordance with a second embodiment of the present invention. The offset actuator rocker arm system shown in FIG. 12 is similar to that shown in FIG. 4, with the exception of the spring 210 used to bias the offset actuator rocker arm 200 toward the cam shaft 300. The coil spring 210 may be disposed between a fixed portion of the engine and a flange 211 extending from the offset actuator rocker arm 200. The spring 210 may have sufficient strength to maintain the offset actuator rocker arm 200 in contact with the auxiliary cam 320 throughout the rotation of the cam shaft. The coil spring 210 may create a lash space 323 between the offset actuator rocker arm 200 and the actuator piston 114. Preferably, the lash space 323 may be at least as great as the height of the lobes on the auxiliary cam 320. When the offset actuator rocker arm 200 is in an "engine brake off" position, as shown in FIG. 12, rotation of the auxiliary cam 320 causes the offset actuator rocker arm 200 to rotate under the influence of the engine braking lobe 330 (and potentially under the influence of the EGR lobe 340 and the BGR lobe 350 in alternative embodiments). The engine braking lobe 330 may cause the offset actuator rocker arm 200 to rotate toward the actuator piston 114, but not far enough to take up the lash space 323 and actuate the engine valve 400 during positive power operation (i.e., "engine brake off" operation).

Figure 13:
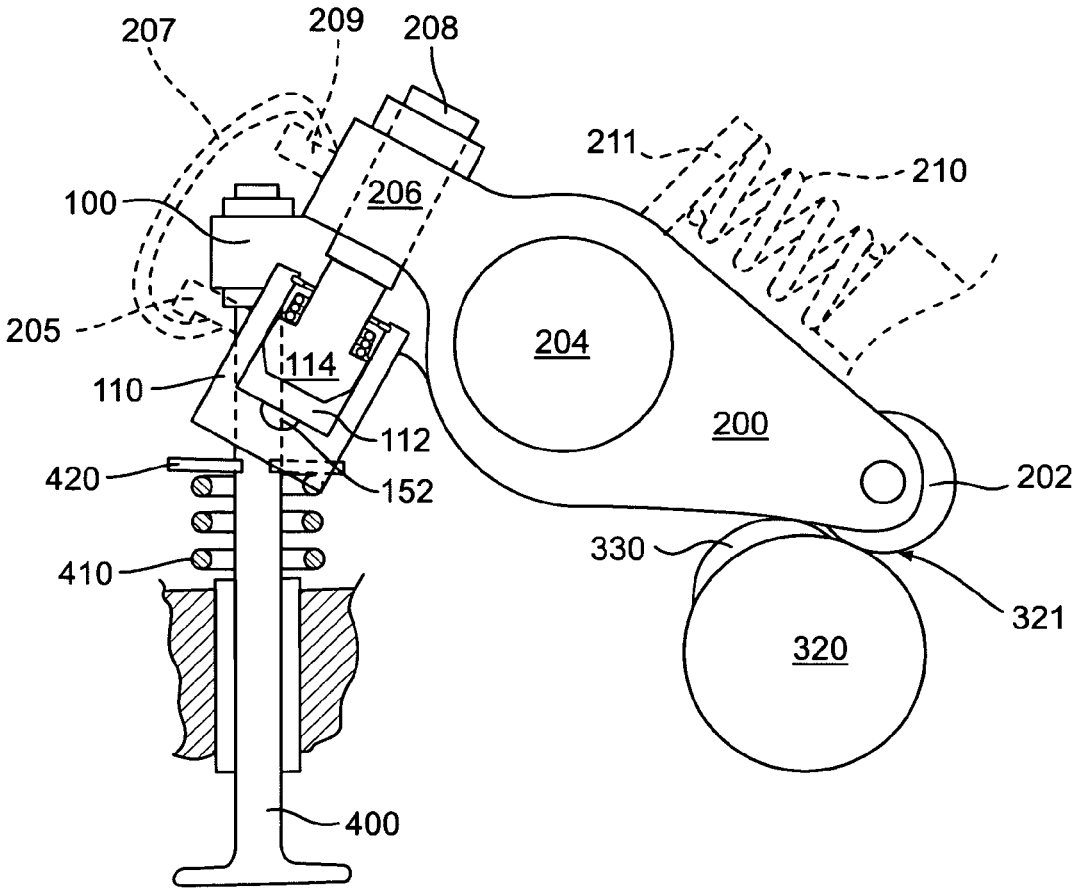
FIG. 13 is a side view in partial cross-section of an offset actuator rocker arm system assembled in accordance with a third embodiment of the present invention.

With reference to FIGS. 12 and 13, during auxiliary valve actuation, the actuator piston 114 may be extended from its bore to take up the lash space 323. When the actuator piston 114 is hydraulically locked into its extended position, the valve actuation motion provided by the lobes on the auxiliary cam 320 may be transmitted through the offset actuator rocker arm 200 and the actuator piston 114 to the exhaust rocker arm 100.

The coil spring 210 shown in FIG. 12 is intended to be exemplary only. In alternative embodiments, other types of springs (e.g., a flat spring) could be disposed in the same or alternate locations (e.g., between the offset actuator rocker arm 200 and the exhaust rocker arm 100) to bias the offset actuator rocker arm into contact with the auxiliary cam 320.

With reference to FIG. 13, a side view in partial cross-section is shown of an offset actuator rocker arm system assembled in accordance with a third embodiment of the present invention. The offset actuator rocker arm system shown in FIG. 13 is similar to that shown in FIGS. 4 and 12, with the exception of the spring 210, which is used to bias the offset actuator rocker arm 200 toward the actuator piston 114. The coil spring 210 may be disposed between a fixed portion of the engine and a flange 211 extending from the offset actuator rocker arm 200. The actuator piston assembly may be similar to those shown in FIGS. 5-7, in which the actuator piston 114 is selectively locked in an outward position only during auxiliary engine valve actuation.

In a first variation of the embodiment shown in FIG. 13, during non-auxiliary engine valve actuation (i.e., an "engine brake off" position), the actuator piston bore 112 may be supplied with a supply of fluid sufficiently pressurized to force the actuator piston 114 into the offset rocker arm 200, and the offset rocker arm back into contact with the auxiliary cam 320 throughout the full rotation of the cam, including auxiliary cam lobe 330. The actuator piston 114 may shuttle in and out of the actuator piston bore 112 as the offset rocker arm 200 pivots during non-auxiliary valve actuation. During auxiliary valve actuation (i.e., an "engine brake on" position), the actuator piston 114 may be locked into an extended position as shown in FIG. 13. When the actuator piston 114 is hydraulically locked into its extended position, the valve actuation motion provided by the auxiliary lobe 330 and/or additional lobes (not shown) on the auxiliary cam 320 may be transmitted through the offset actuator rocker arm 200 and the actuator piston 114 to the exhaust rocker arm 100 to provide auxiliary valve actuation for engine braking, EGR, BGR, and/or the like.

Alternatively, in a second variation of the system shown in FIG. 13, an optional coil spring 210 may force the actuator piston 114 into its bore so that it is maintained in a collapsed state. A lash space 321 may be created between the offset actuator rocker arm cam roller 202 and the auxiliary cam 320 when the coil spring 210 biases the offset actuator rocker arm 200 into the actuator piston 114. Preferably, the lash space 321 may be at least as great as the height of the lobes on the auxiliary cam 320. As a result, rotation of the auxiliary cam 320 may not cause the offset actuator rocker arm 200 to actuate the engine valve 400 during positive power operation. During auxiliary valve actuation, the actuator piston 114 may be extended from its bore and force the offset actuator rocker arm 200 back into contact with the auxiliary cam 320 so as to take up the lash space 321. When the actuator piston 114 is hydraulically locked into its extended position, the valve actuation motion provided by the lobe(s) on the auxiliary cam 320 is transmitted through the offset actuator rocker arm 200 and the actuator piston 114 to the exhaust rocker arm 100 to provide auxiliary valve actuation for engine braking, EGR, BGR, and/or the like.

In an alternative embodiment of the present invention, the coil spring 210 shown in FIG. 13 may be replaced by a clamp spring 207 (shown in phantom). The clamp spring 207 may engage a first flange 209 extending from the offset actuator rocker arm 200 and a second flange 205 extending from the actuator piston boss 110. In other respects, the version of the offset actuator rocker arm 200 shown in FIG. 13 that utilizes a clamp spring 207 operates similarly to the version discussed above, which utilizes a coil spring.

The embodiments of the present invention shown in FIGS. 4, 12 and 13, may be modified to use control valve and actuator piston assemblies such as those shown in FIGS. 8-11 by combining or eliminating the springs 210 (or 207) with constant fluid supply to the actuator piston 114. When the springs 210 or 207 are eliminated, the actuator piston 114 may be biased out of its bore with a constant supply of hydraulic fluid during positive power. The extension of the actuator piston 114 from the piston bore 112 may cause the offset actuator rocker arm 200 to rotate backward into contact with the auxiliary cam 320. The hydraulic pressure extending the actuator piston 114 from its bore maintains the offset actuator rocker arm 200 in contact with the auxiliary cam 320 throughout the rotation of the cam shaft. The extension of the actuator piston 114 effectively creates a lash space inside the actuator piston bore 112 between the actuator piston 114 and the end of the bore. Preferably, the lash space in the actuator piston bore is at least as great as the height of the lobes on the auxiliary cam 320. As a result, rotation of the auxiliary cam 320 may cause the offset actuator rocker arm 200 to rotate and push the actuator piston 114 back into its bore, but not far enough to take up the lash space and actuate the engine valve 400 during positive power operation. During auxiliary valve actuation, the actuator piston 114 may also be extended from its bore, however, the actuator piston may be hydraulically locked into its extended position, so that the valve actuation motion provided by the lobes on the auxiliary cam 320 is transmitted through the offset actuator rocker arm 200 and the actuator piston 114 to the exhaust rocker arm 100.

Figure 14:
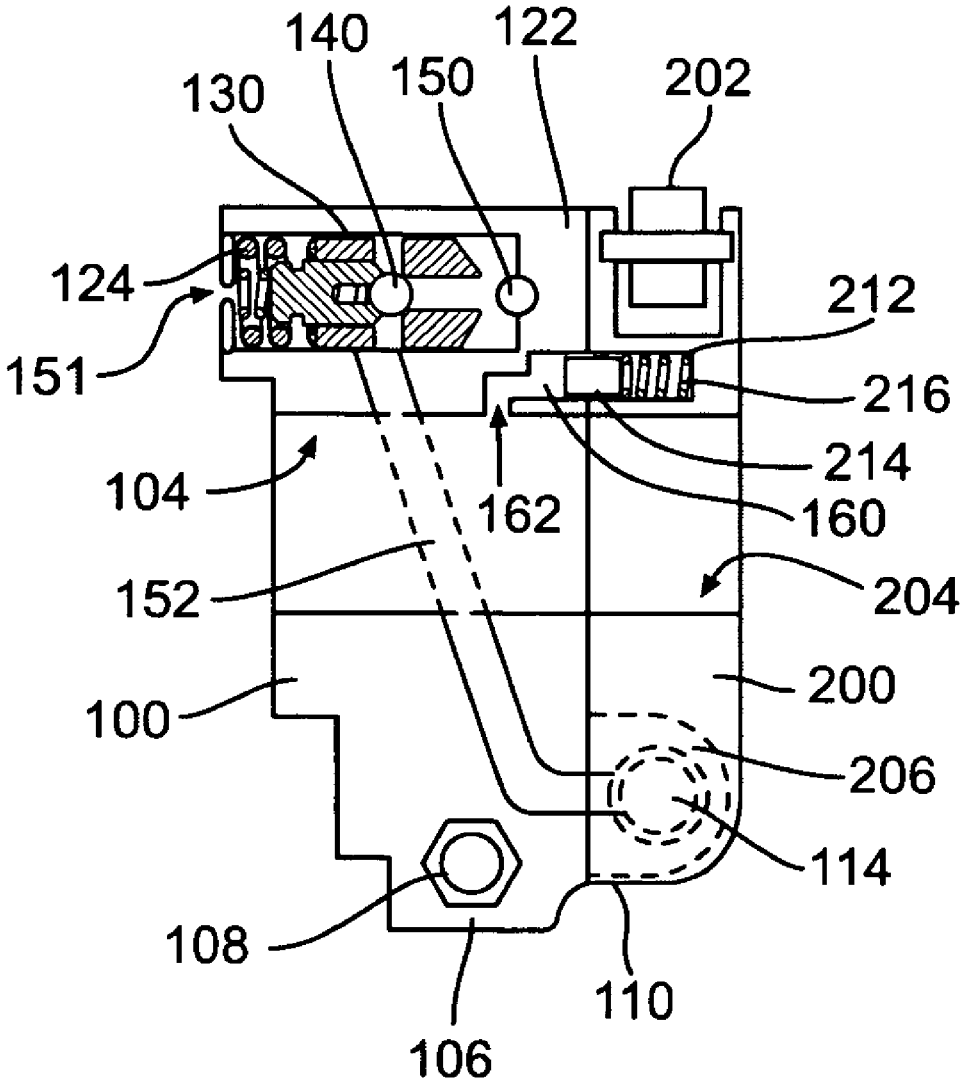
FIG. 14 is a top plan view in partial cross-section of an offset actuator rocker arm system assembled in accordance with a fourth embodiment of the present invention.
Figure 15:
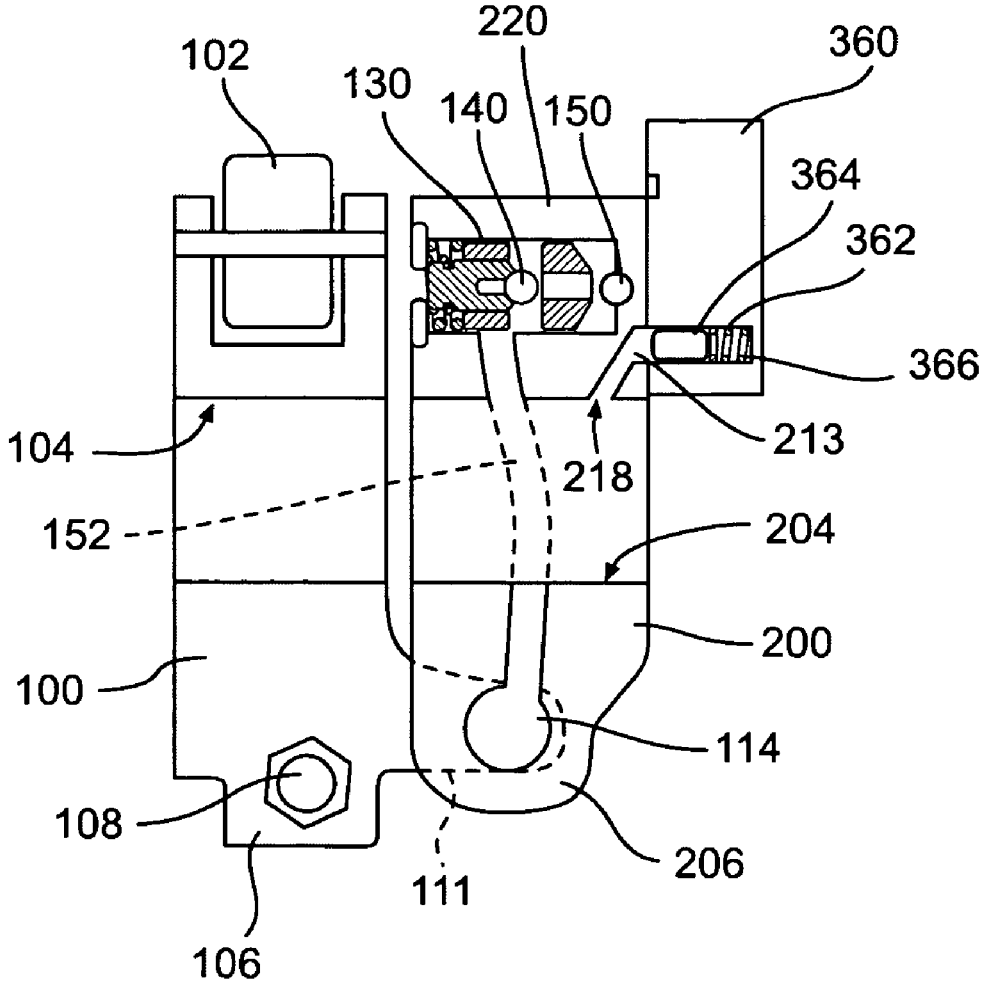
FIG. 15 is a top plan view in partial cross-section of an offset actuator rocker arm system assembled in accordance with a fifth embodiment of the present invention.
Figure 16:
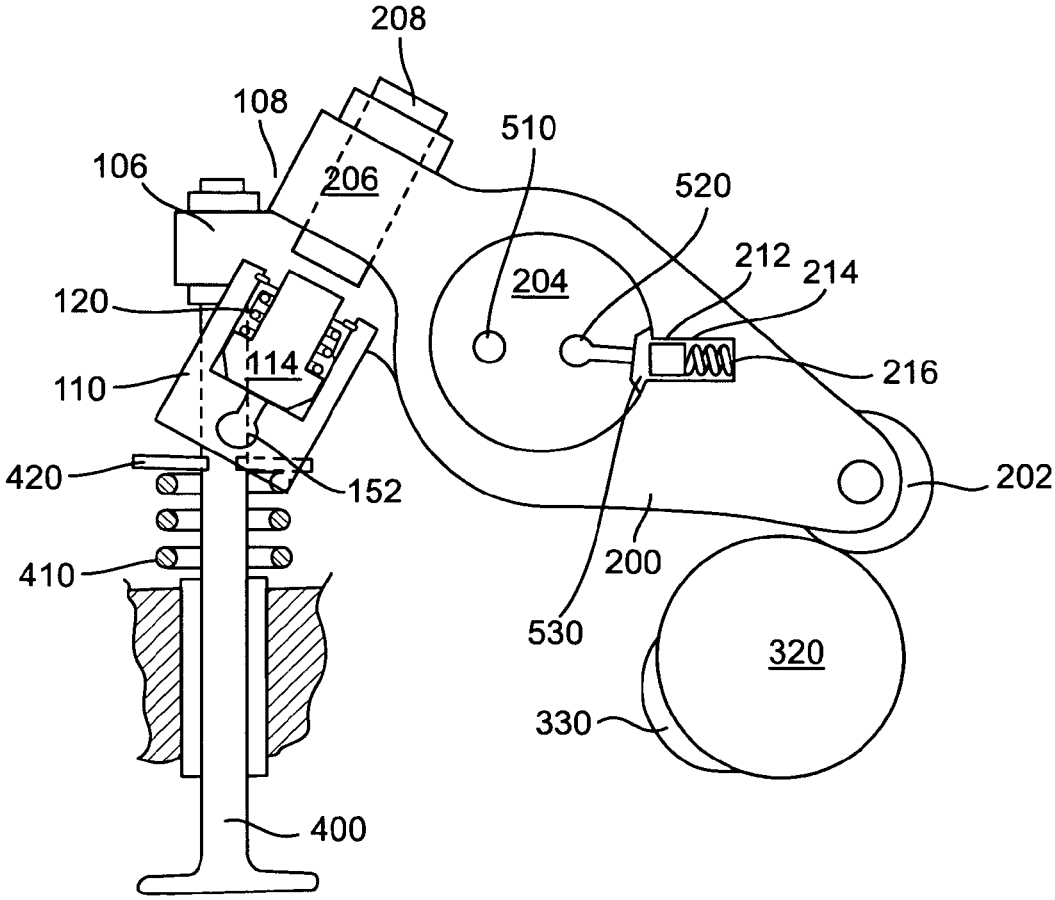
FIG. 16 is a side view in partial cross-section of an offset actuator rocker arm system assembled in accordance with a sixth embodiment of the present invention.

Each of the embodiments of the present invention shown in FIGS. 14-16 may include a means for locking the offset actuator rocker arm 200 into a position that prevents it from contacting the auxiliary cam 320 during positive power operation of the engine. Each means for locking may include a detent opening, a detent bore, a detent pin, and a spring for biasing the detent pin out of the detent bore. During positive power operation of the engine, the means for locking may lock the offset actuator rocker arm 200 to the exhaust rocker arm 100 (see FIG. 14), a camshaft bearing cap 360 (see FIG. 15), or the rocker arm shaft 500 (see FIG. 16). As a result, the offset actuator rocker arm 200 may be prevented from loosely pivoting between and impacting the auxiliary cam 320 and the actuator piston 114 during positive power operation.

A fourth embodiment of the present invention is shown in FIG. 14. With reference to FIG. 14, a detent piston 214 may be slidably disposed in a detent bore 212 formed in the offset actuator rocker arm 200. The detent piston 214 may have a longitudinal axis extending in a substantially parallel direction relative to the axis of rocker arm shaft 500. A detent spring 216 may bias the detent piston 214 out of the detent bore 212 towards the exhaust rocker arm 100. A detent opening 160, adapted to receive the detent piston 214, may be formed in the side of the exhaust rocker arm 100. The detent opening 160 may be located such that the detent piston 214 engages the detent opening and locks the offset actuator rocker arm to the exhaust rocker arm when the offset actuator rocker arm is pivoted away from the auxiliary cam 320. The detent piston 214 may disengage the detent opening when hydraulic fluid pressure in the detent fluid passage 162 exceeds the counter-force applied to the detent piston 214 by the detent spring 216. A control fluid passage 520 (see FIG. 16) may be formed in the rocker arm shaft 500 to provide fluid to the detent fluid passage 162 and the control fluid supply passage 150. A hydraulic control valve (not shown) may control the application of fluid pressure in the control fluid supply passage 520. During positive power operation, fluid pressure in the control fluid supply passage 520 may be maintained low to allow the detent piston 214 to lock the offset actuator rocker arm 200 to the exhaust rocker arm 100. During auxiliary valve actuation operation, fluid pressure in the control fluid supply passage 520 may be increased to unlock the offset actuator rocker arm 200 from the exhaust rocker arm and shuttle the control valve piston 130. After the offset rocker arm 200 is unlocked and the control valve piston 130 is shuttled to provide fluid to the actuator piston 114, the system operates similarly to the above-described systems.

A fifth embodiment of the present invention is shown in FIG. 15. With reference to FIG. 15, the valve actuation system may be modified from that shown in FIG. 14 so that the actuator piston 114 is disposed in the offset actuator rocker arm 200 instead of in the exhaust rocker arm 100. The actuator piston 114 may be slidably disposed in the valve actuation end 206 of the offset actuator rocker arm 200. The offset actuator rocker arm 200 may include a control valve piston 130 disposed in a control valve boss 220, and one or more internal passages 150, 152, and the like, for the delivery of hydraulic fluid to the actuator piston 114. The rocker shaft bore 204 extending through the offset actuator rocker arm 200 may include one or more ports formed in the wall thereof to receive fluid from the fluid passages formed in the rocker arm shaft 500. Operationally, when the actuator piston 114 is installed in the offset actuator rocker arm 200, it may operate in the same manner as it does in any other embodiments of the invention. When it is desired to use the offset actuator rocker arm 200 to provide auxiliary valve actuation, the actuator piston 114 may be selectively hydraulically locked into an extended position to take up any lash between the actuator piston and a flange 111 extending laterally from the exhaust rocker arm 100. Subsequent downward rotation of the offset actuator rocker arm 200 acts on the exhaust rocker arm 100 through the flange 111 to open the exhaust valve for auxiliary valve events.

With continued reference to FIG. 15, a detent piston 364 may be slidably disposed in a detent bore 362 formed in a cam bearing cap 360. A detent spring 366 may bias the detent piston 364 out of the detent bore 362 towards the offset actuator rocker arm 200. A detent opening 213, adapted to receive the detent piston 364, may be formed in the side of the offset actuator rocker arm 200. The detent opening 213 may be located such that the detent piston 364 engages the detent opening and locks the offset actuator rocker arm 200 to the cam bearing cap 360 when the offset actuator rocker arm is pivoted away from the auxiliary cam 320. The detent piston 364 may disengage the detent opening 213 when hydraulic fluid pressure in the detent fluid passage 218 exceeds the counter-force applied to the detent piston 364 by the detent spring 366. As in the previously described embodiment, a control fluid supply passage 520 (see FIG. 16) may be formed in the rocker arm shaft 500 to provide fluid to the detent fluid passage 218 and the control fluid supply passage 150. Fluid pressure in the control fluid supply passage 520 may be varied to lock and unlock the offset actuator rocker arm from the cam bearing cap 360.

Although the afore-noted embodiment of the present invention, in which the offset actuator rocker arm 200 contains the actuator piston 114, is described as including a detent piston for locking the offset actuator rocker arm to a cam bearing cap 360, it is appreciated that in alternative embodiments of the invention the actuator piston 114 could be provided in the offset actuator rocker arm without the inclusion of a detent piston to lock the offset actuator rocker arm to the cam bearing cap. Alternate or no means for locking the offset actuator rocker arm 200 during positive power operation could be substituted for the detent piston in the cam bearing cap 360. Further, it is appreciated that the location of the detent piston bore and detent opening in each of the embodiments of the present invention shown in FIGS. 14-16 could be reversed without departing from the intended scope of the invention. For example, with reference to FIG. 15, the detent piston bore 362 could alternatively be located in the offset actuator rocker arm 200, and the detent opening 213 could alternatively be located in the cam bearing cap 360.

A sixth embodiment of the present invention is shown in FIG. 16. With reference to FIG. 16, a detent piston 214 may be slidably disposed in a detent bore 212 formed in the offset actuator rocker arm 200. The detent piston 214 may have a longitudinal axis extending in a perpendicular direction relative to the axis of rocker arm shaft 500. A detent spring 216 may bias the detent piston 214 out of the detent bore 212 towards the rocker arm shaft 500. A detent opening 530, adapted to receive the detent piston 214, may be formed in the side of the rocker arm shaft 500. The detent opening 530 may be located such that the detent piston 214 engages the detent opening and locks the offset actuator rocker arm to the rocker arm shaft 500 when the offset actuator rocker arm is pivoted away from the auxiliary cam 320. Thus, the detent piston 214 may be used to selectively lock the offset actuator rocker arm 200 so that it is operationally unaffected by the auxiliary cam 320. The detent piston 214 may disengage the detent opening 530 when hydraulic fluid pressure in the detent control passage 540 exceeds the counter-force applied to the detent piston 214 by the detent spring 216. A hydraulic control valve (not shown) may control the application of fluid pressure in the control passage 540. The additional control passage 540 in the rocker arm shaft 500 may provide fluid to the detent opening 530. As described above, fluid pressure in the control passage 540 may be varied to selectively lock and unlock the offset actuator rocker arm from the rocker shaft 500.

Figure 17:
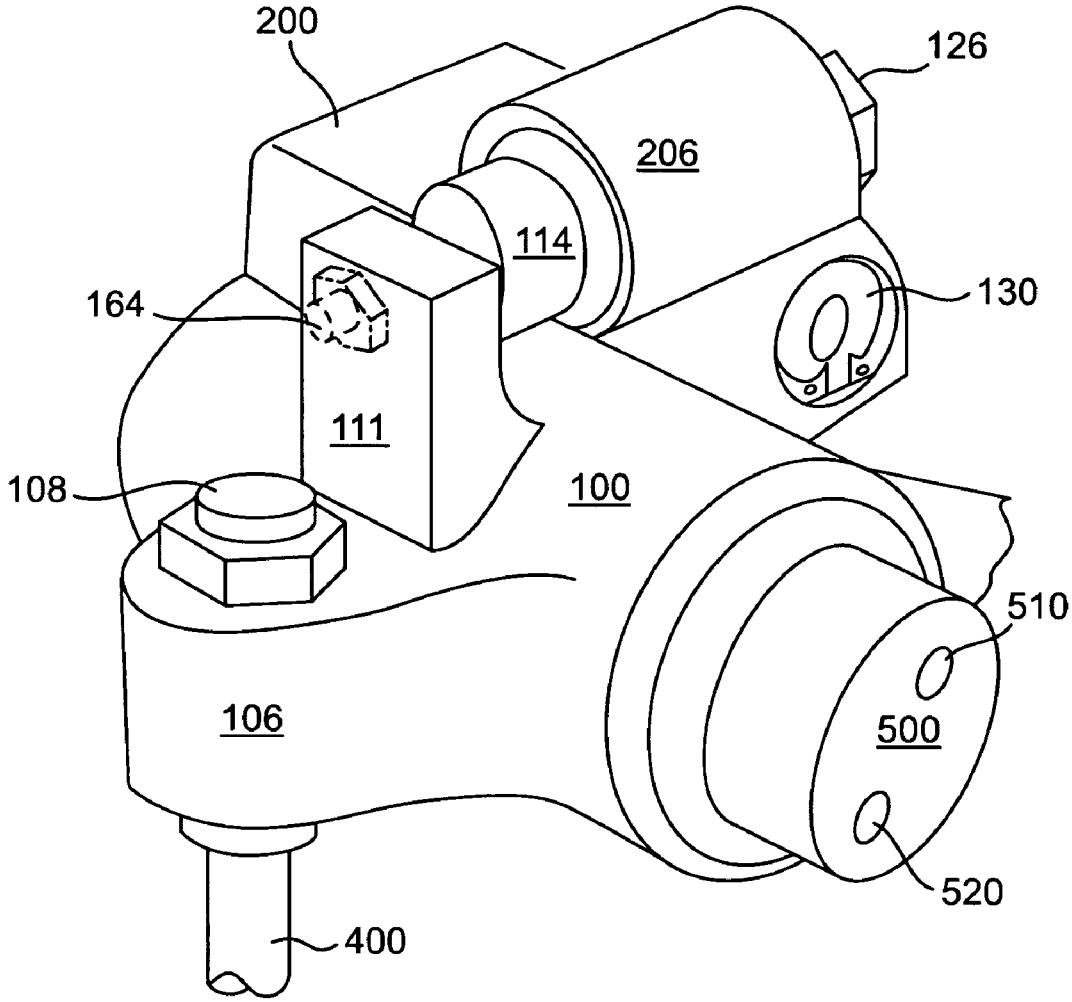
FIG. 17 is a pictorial view of an offset actuator rocker arm system assembled in accordance with a seventh embodiment of the present invention.

A seventh embodiment of the present invention is shown in FIG. 17. The embodiment shown in FIG. 17 is similar to that shown in FIG. 15, with the major difference being the shape of the offset actuator rocker arm 200, which is truncated compared to conventional rocker arms. With reference to FIG. 17, the actuator piston 114 is disposed in the valve actuation end 206 of the offset actuator rocker arm 200 instead of in the exhaust rocker arm 100. The offset actuator rocker arm 200 may include a control valve piston 130 disposed in a control valve boss, and one or more internal passages for the delivery of hydraulic fluid from the rocker shaft passages 510 and/or 520 to the actuator piston 114. The rocker shaft bore extending through the offset actuator rocker arm 200 may include one or more ports formed in the wall thereof to receive fluid from the fluid passages formed in the rocker arm shaft 500. An optional actuator piston lash adjuster 126 may be screwed into the bore housing the actuator piston 114. A second optional lash adjuster 164 may be screwed into a flange 111 extending from the top of the exhaust rocker arm 100. Operationally, when the actuator piston 114 is installed in the offset actuator rocker arm 200, it may operate in the same manner as it does in any other embodiments of the invention. When it is desired to use the offset actuator rocker arm 200 to provide auxiliary valve actuation, the actuator piston 114 may be selectively hydraulically locked into an extended position to take up any lash between the actuator piston and the flange 111 extending from the exhaust rocker arm 100. Subsequent rotation of the offset actuator rocker arm 200 acts on the exhaust rocker arm 100 through the flange 111 to open the exhaust valve for auxiliary valve events.

Figure 18:
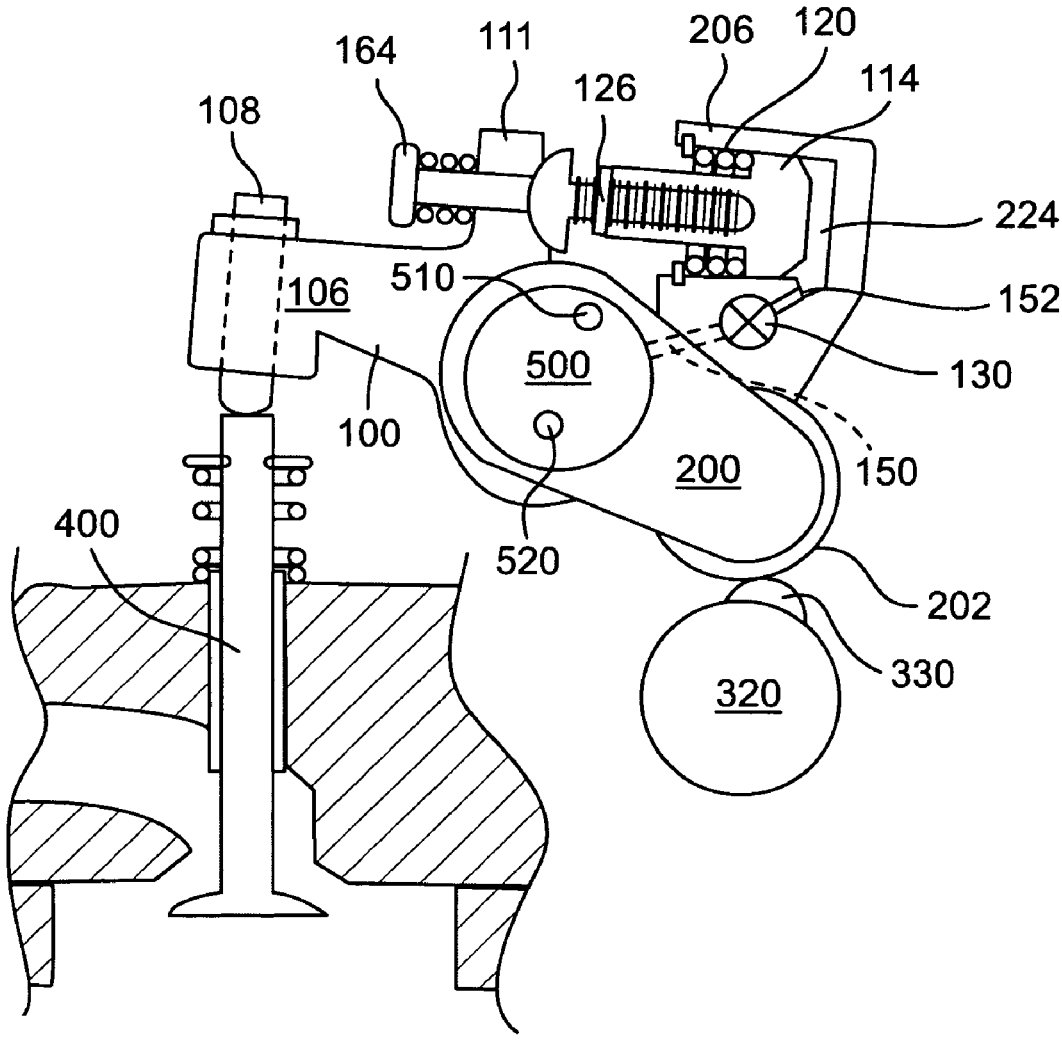
FIG. 18 is a side view in partial cross-section of the embodiment of the present invention shown in FIG. 17.
Figure 19:
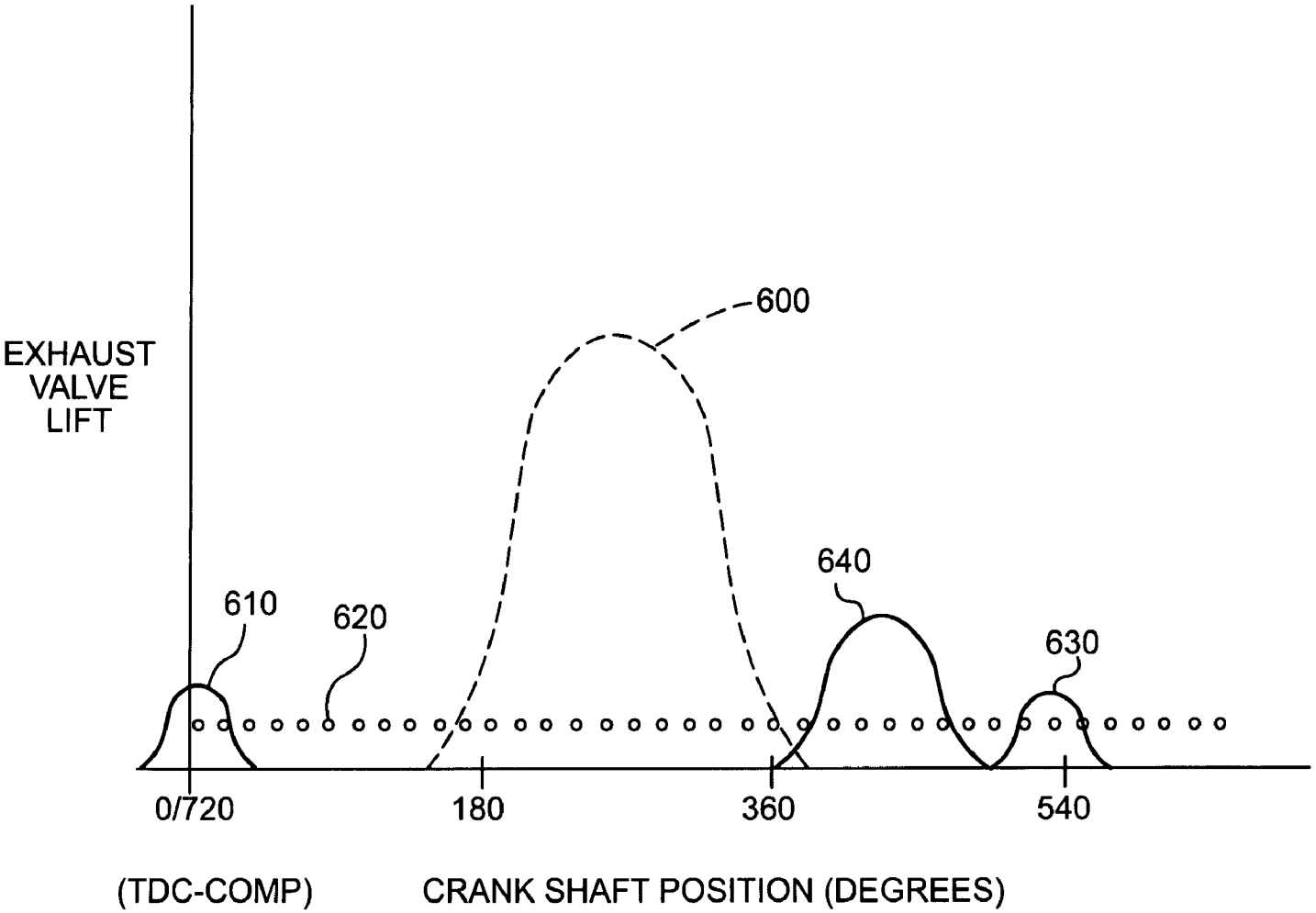
FIG. 19 is a graph of a number of different and exemplary auxiliary valve events.
Figure 20:
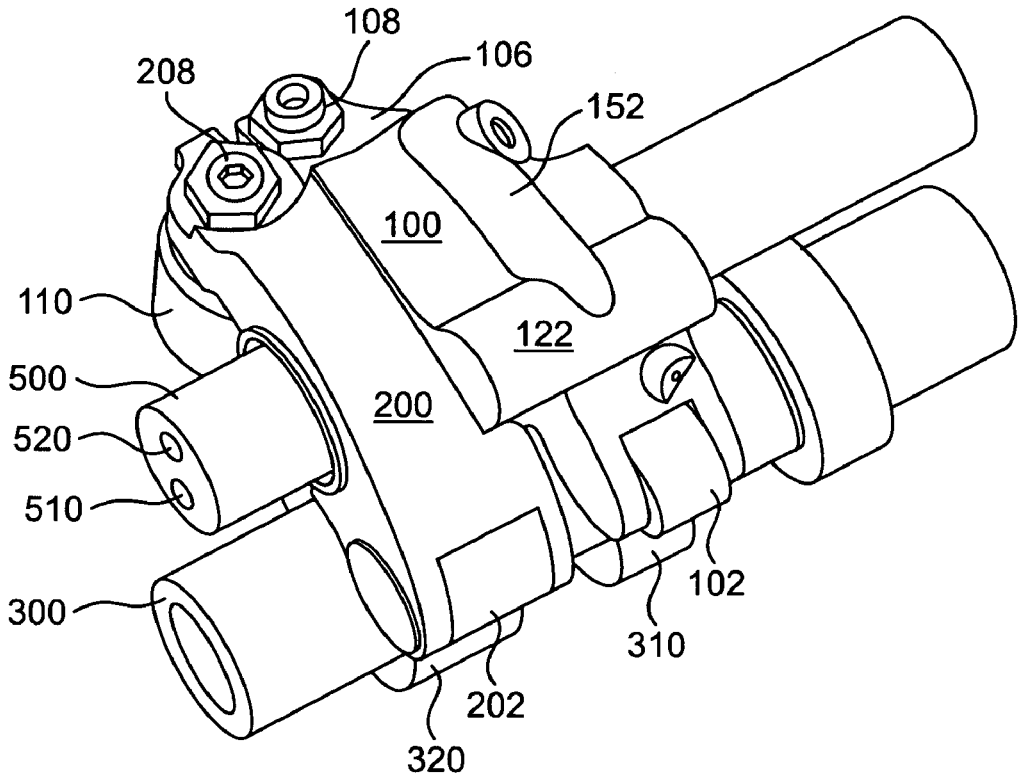
FIG. 20 a pictorial view of the rear side of an offset actuator rocker arm system assembled in accordance with the first embodiment of the present invention.

The embodiment of the present invention shown in FIG. 18 differs from that shown in FIG. 17 primarily in the location of the first optional lash adjuster 126. In the embodiment shown in FIG. 18, the first optional lash adjuster 126 may extend from the actuator piston 114. The lash adjuster 126 may have a rounded head adapted to mate with a concave surface formed on the flange 111.

It will be apparent to those skilled in the art that variations and modifications of the present invention can be made without departing from the scope or spirit of the invention. For example, it is appreciated that the exhaust rocker arm 100 could be implemented as an intake rocker arm, or an auxiliary rocker arm, without departing from the intended scope of the invention. Furthermore, various embodiments of the invention may or may not include a means for biasing the offset rocker arm 200 toward either the auxiliary cam 320, or the actuator piston 114. These and other modifications to the above-described embodiments of the invention may be made without departing from the intended scope of the invention.

What is claimed is:

1. A system for actuating an engine valve comprising:

a rocker arm shaft;

a means for imparting primary valve actuation motion;

a primary rocker arm disposed on the rocker arm shaft, said primary rocker arm being adapted to actuate an engine valve and receive motion from the means for imparting primary valve actuation motion;

a means for imparting auxiliary valve actuation motion;

an auxiliary rocker arm disposed on the rocker arm shaft adjacent to the primary rocker arm, said auxiliary rocker arm having a first end adapted to receive motion from the means for imparting auxiliary valve actuation motion and a second end distal from the auxiliary rocker arm first end;

a hydraulic actuator piston disposed between the second end of the auxiliary rocker arm and the primary rocker arm, said actuator piston being adapted to selectively transfer one or more auxiliary valve actuation motions from the auxiliary rocker arm to the primary rocker arm; and means for locking the hydraulic actuator piston in a fixed position relative to the auxiliary rocker arm or the primary rocker arm during a time that the auxiliary rocker arm receives motion from the means for imparting auxiliary valve actuation motion.

2. The system of claim 1 wherein the one or more auxiliary valve actuation motions are transferred from the primary rocker arm to the engine valve through a valve train element selected from the group consisting of: the valve, a valve bridge, and a pin.

3. The system of claim 1 further comprising an actuator bore formed in the primary rocker arm, wherein the actuator piston is disposed in the actuator bore.

4. The system of claim 3, the means for locking the hydraulic actuator piston comprising:

a control valve bore formed in the primary rocker arm;

a control valve piston disposed in the control valve bore;

a first hydraulic fluid passage extending from the control valve bore to the actuator bore; and a second hydraulic fluid passage communicating with the control valve bore.

5. The system of claim 4 further comprising:

a check valve disposed in the first hydraulic fluid passage; and a hydraulic fluid drain passage extending from the control valve bore to the actuator bore.

6. The system of claim 4 further comprising:

a check valve disposed in the first hydraulic fluid passage;

a protrusion extending from the control valve piston toward the check valve, said protrusion being adapted to selectively open the check valve; and a control valve spring biasing the control valve piston toward the check valve.

7. The system of claim 3 further comprising:

a control valve bore formed in the primary rocker arm;

a control valve piston disposed in the control valve bore;

a first hydraulic fluid passage communicating with the control valve bore;

a second hydraulic fluid passage extending from a hydraulic fluid supply to the actuator piston bore;

a check valve disposed in the second hydraulic fluid passage;

a pin extending from the control valve piston to the check valve, said pin being adapted to open the check valve; and a control valve spring biasing the control valve piston toward the check valve.

8. The system of claim 3 further comprising:

a control valve bore formed in the primary rocker arm;

a control valve piston disposed in the control valve bore;

a first fluid passage extending from a control fluid source to the control valve bore;

a second hydraulic fluid passage extending from the control valve bore to the actuator piston bore;

a check valve disposed in the second hydraulic fluid passage;

a third hydraulic fluid passage extending from a constant fluid supply to the control valve bore;

a fourth hydraulic fluid passage extending from the control valve bore to the actuator piston bore; and a control valve spring biasing the control valve piston into the control valve bore, wherein the control valve piston is adapted to provide selective communication between (i) the first and second hydraulic fluid passages, and (ii) the third and fourth hydraulic fluid passages.

9. The system of claim 4 further comprising:

a check valve disposed in the first hydraulic fluid passage;

a protrusion extending from the control valve piston toward the check valve, said protrusion being adapted to selectively open the check valve;

a control valve spring biasing the control valve piston toward the check valve; and a third hydraulic fluid passage communicating with a control valve spring side of the control valve, wherein the second hydraulic fluid passage communicates with a protrusion side of the control valve.

10. The system of claim 3 further comprising:

a first control valve bore formed in the primary rocker arm;

a first control valve piston disposed in the first control valve bore, said first control valve piston including a protrusion and having a protrusion side and a control side;

a first fluid passage extending from a constant fluid supply to the first control valve bore on the protrusion side of the first control valve piston;

a second hydraulic fluid passage extending from the first control valve bore to the actuator piston bore;

a check valve disposed in the second hydraulic fluid passage;

a second control valve bore;

a second control valve piston disposed in the second control valve bore;

a third hydraulic fluid passage extending from a control fluid source to the second control valve bore;

a fourth hydraulic fluid passage extending from the constant fluid supply to the second control valve bore;

a fifth hydraulic fluid passage extending from the second control valve bore as a hydraulic fluid drain;

a sixth hydraulic fluid passage extending from the second control valve bore to the first control valve bore on the control side of the first control valve piston, wherein the second control valve piston is adapted to provide selective communication between (i) the fourth and sixth hydraulic fluid passages, and (ii) the fifth and sixth hydraulic fluid passages.

11. The system of claim 3 further comprising an actuator piston spring biasing the actuator piston into the actuator bore.

12. The system of claim 4 wherein the second hydraulic fluid passage extends through the primary rocker arm from the rocker shaft to the control valve bore.

13. The system of claim 4 further comprising a check valve incorporated into the control valve piston.

14. The system of claim 3 further comprising a means for biasing the auxiliary rocker arm toward the means for imparting auxiliary valve actuation motion.

15. The system of claim 14 wherein the means for biasing comprises a spring.

16. The system of claim 3 further comprising a means for biasing the auxiliary rocker arm toward the actuator piston.

17. The system of claim 16 wherein the means for biasing comprises a spring.

18. The system of claim 3 further comprising means for selectively locking the primary rocker arm and the auxiliary rocker arm together.

19. The system of claim 18, wherein no auxiliary valve actuation motion is imparted to the engine valve when the primary rocker arm and the auxiliary rocker arm are locked together.

20. The system of claim 18 wherein the means for selectively locking comprises a detent pin assembly.

21. The system of claim 3 wherein the actuator bore is formed in a boss formed near an end of the primary rocker arm.

22. The system of claim 3 further comprising means for biasing the actuator piston and the auxiliary rocker arm into contact with each other during a primary valve actuation mode of engine operation.

23. The system of claim 1, wherein the auxiliary valve actuation motion is selected from the group consisting of: engine braking motion, exhaust gas recirculation motion, auxiliary intake motion, and brake gas recirculation motion.

24. The system of claim 1 further comprising:

an actuator bore formed in the second end of the auxiliary rocker arm, wherein the actuator piston is disposed in the actuator bore; and a flange extending from the primary rocker arm, said flange being adapted to contact the actuator piston.

25. The system of claim 24 further comprising:

a control valve bore formed in the auxiliary rocker arm;

a control valve piston disposed in the control valve bore;

a first hydraulic fluid passage extending from the control valve bore to the actuator bore; and a second hydraulic fluid passage communicating with the control valve bore.

26. The system of claim 25 further comprising:

a check valve disposed in the first hydraulic fluid passage; and a hydraulic fluid drain passage extending from the control valve bore to the actuator bore.

27. The system of claim 25 further comprising:

a check valve disposed in the first hydraulic fluid passage;

a protrusion extending from the control valve piston toward the check valve, said protrusion being adapted to selectively open the check valve; and a control valve spring biasing the control valve piston toward the check valve.

28. The system of claim 24 further comprising:

a control valve bore formed in the auxiliary rocker arm;

a control valve piston disposed in the control valve bore;

a first hydraulic fluid passage communicating with the control valve bore;

a second hydraulic fluid passage extending from a hydraulic fluid supply to the actuator piston bore;

a check valve disposed in the second hydraulic fluid passage;

a pin extending from the control valve piston to the check valve, said pin being adapted to open the check valve; and a control valve spring biasing the control valve piston toward the check valve.

29. The system of claim 24 further comprising:

a control valve bore formed in the auxiliary rocker arm;

a control valve piston disposed in the control valve bore;

a first fluid passage extending from a control fluid source to the control valve bore;

a second hydraulic fluid passage extending from the control valve bore to the actuator piston bore;

a check valve disposed in the second hydraulic fluid passage;

a third hydraulic fluid passage extending from a constant fluid supply to the control valve bore;

a fourth hydraulic fluid passage extending from the control valve bore to the actuator piston bore; and a control valve spring biasing the control valve piston into the control valve bore, wherein the control valve piston is adapted to provide selective communication between (i) the first and second hydraulic fluid passages, and (ii) the third and fourth hydraulic fluid passages.

30. The system of claim 25 further comprising:

a check valve disposed in the first hydraulic fluid passage;

a protrusion extending from the control valve piston toward the check valve, said protrusion being adapted to selectively open the check valve;

a control valve spring biasing the control valve piston toward the check valve; and a third hydraulic fluid passage communicating with a control valve spring side of the control valve, wherein the second hydraulic fluid passage communicates with a protrusion side of the control valve.

31. The system of claim 24 further comprising:

a first control valve bore formed in the auxiliary rocker arm;

a first control valve piston disposed in the first control valve bore, said first control valve piston including a protrusion and having a protrusion side and a control side;

a first fluid passage extending from a constant fluid supply to the first control valve bore on the protrusion side of the first control valve piston;

a second hydraulic fluid passage extending from the first control valve bore to the actuator piston bore;

a check valve disposed in the second hydraulic fluid passage;

a second control valve bore;

a second control valve piston disposed in the second control valve bore;

a third hydraulic fluid passage extending from a control fluid source to the second control valve bore;

a fourth hydraulic fluid passage extending from the constant fluid supply to the second control valve bore;

a fifth hydraulic fluid passage extending from the second control valve bore as a hydraulic fluid drain;

a sixth hydraulic fluid passage extending from the second control valve bore to the first control valve bore on the control side of the first control valve piston, wherein the second control valve piston is adapted to provide selective communication between (i) the fourth and sixth hydraulic fluid passages, and (ii) the fifth and sixth hydraulic fluid passages.

32. The system of claim 24 further comprising an actuator piston spring biasing the actuator piston into the actuator bore.

33. The system of claim 25 wherein the second hydraulic fluid passage extends through the auxiliary rocker arm from the rocker shaft to the control valve bore.

34. The system of claim 25 further comprising a check valve incorporated into the control valve piston.

35. The system of claim 24 further comprising a means for biasing the auxiliary rocker arm toward the means for imparting auxiliary valve actuation motion.

36. The system of claim 35 wherein the means for biasing comprises a spring.

37. The system of claim 24 further comprising a means for biasing the auxiliary rocker arm toward the flange on the primary rocker arm.

38. The system of claim 37 wherein the means for biasing comprises a spring.

39. The system of claim 24 further comprising means for selectively locking the primary rocker arm and the auxiliary rocker arm together.

40. The system of claim 39 wherein the means for selectively locking comprises a detent pin assembly.

41. The system of claim 24 further comprising means for biasing the primary rocker arm and the actuator piston into contact with each other during a primary valve actuation mode of engine operation.

42. The system of claim 1 further comprising means for biasing the actuator piston into contact with the primary rocker arm during a primary valve actuation mode of engine operation.

43. The system of claim 3 further comprising means for adjusting a lash space between the actuator piston and the auxiliary rocker arm.

44. The system of claim 24 further comprising means for adjusting a lash space between the actuator piston and the primary rocker arm.

45. A method of actuating an engine valve for primary and auxiliary valve actuation events using a primary rocker arm, an auxiliary rocker arm, and a hydraulic actuator piston disposed between the ends of the primary and auxiliary rocker arms that are proximal to the engine valve, said method comprising the steps of:

actuating the engine valve for a primary valve actuation event responsive to motion imparted from a first valve train element to the primary rocker arm during a primary valve actuation mode of engine operation;

extending and locking the hydraulic actuator piston into a fixed position between the actuation ends of the primary and auxiliary rocker arms during a time that motion is imparted to the auxiliary rocker arm such that the hydraulic actuator piston provides selective contact between the primary and auxiliary rocker arms without the hydraulic actuator piston locking the primary and auxiliary rocker arms together;

actuating the engine valve for one or more auxiliary valve actuation events responsive to motion imparted from a second valve train element to the auxiliary rocker arm during an auxiliary valve actuation mode of engine operation.

46. The method of claim 45 wherein the auxiliary valve actuation events are selected from the group consisting of: an exhaust gas recirculation event and a brake gas recirculation event.

47. The method of claim 45 wherein the engine valve comprises an intake valve.

48. A system for actuating an engine valve comprising:

a rocker arm shaft;

a first rocker arm disposed on the rocker arm shaft and having an end proximal to the engine valve;

a means for imparting a first valve actuation motion to the first rocker arm;

a second rocker arm disposed on the rocker arm shaft adjacent to the first rocker arm, said second rocker arm having an end proximal to the engine valve;

a means for imparting one or more second valve actuation motions to the second rocker arm, said second valve actuation motions being selected from the group consisting of: engine braking motion, exhaust gas recirculation motion, main exhaust motion, main intake motion, auxiliary intake motion, and brake gas recirculation motion;

a hydraulic actuator piston disposed between the ends of the second rocker arm and the first rocker arm that are proximal to the engine valve, said actuator piston having an axis extending in a direction substantially co-planar with a rotation direction of the first and second rocker arms; and a hydraulic fluid control valve disposed in either the first rocker arm or the second rocker arm, said control valve adapted to selectively control the position of the hydraulic actuator piston and lock the hydraulic actuator piston in a fixed position relative to the first rocker arm or the second rocker arm during a time that the second rocker arm receives motion from the means for imparting one or more second valve actuation motions.

49. The system of claim 48 wherein the hydraulic actuator piston is laterally offset from the first rocker arm in the direction of the second rocker arm.

50. The system of claim 48 wherein the hydraulic actuator piston is laterally offset from the second rocker arm in the direction of the first rocker arm.

51. The system of claim 48 wherein the first rocker arm is selected from the group consisting of an intake rocker arm, an exhaust rocker arm, and an auxiliary rocker arm.

52. The system of claim 48 wherein the one or more second valve actuation motions are transferred from the first rocker arm to the engine valve either directly or through a valve train element selected from the group consisting of: a valve bridge, and a pin.

53. The system of claim 48 wherein the hydraulic actuator piston provides substantially constant contact between the first and second rocker arms during all modes of engine operation.

54. The system of claim 53 wherein the hydraulic actuator piston is selectively locked during an exhaust gas recirculation mode of engine operation.

55. The system of claim 48 further comprising a means for biasing the second rocker arm toward the means for imparting one or more second valve actuation motions.

56. The system of claim 48 further comprising a means for biasing the second rocker arm toward the first rocker arm.

57. The system of claim 48 further comprising means for selectively locking the first rocker arm and the second rocker arm together.

58. The system of claim 48 further comprising means for adjusting a lash space between the actuator piston and the first or second rocker arm.

* * * * *